US010711773B2

(12) United States Patent
Ha et al.

(10) Patent No.: US 10,711,773 B2
(45) Date of Patent: Jul. 14, 2020

(54) LINEAR COMPRESSOR

(71) Applicant: LG ELECTRONICS INC., Seoul (KR)

(72) Inventors: Seongho Ha, Seoul (KR); Donghan Kim, Seoul (KR); Jaeyoun Lim, Seoul (KR); Kichul Choi, Seoul (KR); Jungwan Heo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 238 days.

(21) Appl. No.: 15/497,567

(22) Filed: Apr. 26, 2017

(65) Prior Publication Data

US 2017/0314542 A1 Nov. 2, 2017

(30) Foreign Application Priority Data

Apr. 28, 2016 (KR) ..... 10-2016-0052183

(51) Int. Cl.

| | |
|---|---|
| ***F04B 39/00*** | (2006.01) |
| ***F04B 39/12*** | (2006.01) |
| ***F04B 35/04*** | (2006.01) |
| ***F04B 39/16*** | (2006.01) |

(52) U.S. Cl.

CPC ..... *F04B 39/0005* (2013.01); *F04B 35/04* (2013.01); *F04B 35/045* (2013.01); *F04B 39/0016* (2013.01); *F04B 39/122* (2013.01); *F04B 39/123* (2013.01); *F04B 39/16* (2013.01)

(58) Field of Classification Search

USPC ..... 92/2

See application file for complete search history.

(56) References Cited

U.S. PATENT DOCUMENTS

| | | | | |
|---|---|---|---|---|
| 5,050,485 | A * | 9/1991 | Hoult | F16J 1/08 123/193.6 |
| 6,293,184 | B1 * | 9/2001 | Unger | F02G 1/0435 384/12 |
| 7,913,613 | B2 * | 3/2011 | Muth | F04B 35/045 92/169.1 |
| 9,494,148 | B2 * | 11/2016 | Ahn | F04B 39/0005 |
| 2008/0008610 | A1 * | 1/2008 | Muth | F04B 35/045 417/416 |
| 2013/0058815 | A1 * | 3/2013 | Kim | F04B 35/045 417/437 |
| 2013/0058816 | A1 * | 3/2013 | Kim | F04B 35/045 417/437 |

(Continued)

FOREIGN PATENT DOCUMENTS

| | | |
|---|---|---|
| CN | 1759246 | 4/2006 |
| CN | 104251197 | 12/2014 |

(Continued)

OTHER PUBLICATIONS

European Search Report dated Sep. 22, 2017 issued in Application No. 17168440.0.

(Continued)

*Primary Examiner* — Peter J Bertheaud
*Assistant Examiner* — Geoffrey S Lee
(74) *Attorney, Agent, or Firm* — KED & Associates LLP

(57) ABSTRACT

A linear compressor is provided. The linear compressor may include a piston having a first piston groove and a second piston groove.

19 Claims, 17 Drawing Sheets

(56) References Cited

U.S. PATENT DOCUMENTS

| | | | | |
|---|---|---|---|---|
| 2013/0167798 | A1* | 7/2013 | Lawler | F02F 1/18<br>123/193.4 |
| 2015/0135944 | A1* | 5/2015 | Muth | F04B 39/0005<br>92/80 |
| 2015/0369224 | A1* | 12/2015 | Kim | F04B 39/126<br>417/443 |

FOREIGN PATENT DOCUMENTS

| | | |
|---|---|---|
| CN | 105298799 | 2/2016 |
| EP | 2 568 173 | 3/2013 |
| EP | 2 818 713 | 12/2014 |
| EP | 2 960 505 | 12/2015 |
| KR | 10-2003-0090001 | 11/2003 |
| KR | 10-1307688 | 9/2013 |
| KR | 10-2016-0000324 | 1/2016 |
| RU | 2429377 | 9/2011 |
| RU | 2451845 | 5/2012 |
| WO | WO 2008/108752 | 9/2008 |

OTHER PUBLICATIONS

Chinese Office Action dated Jul. 16, 2018.
Russian Office Action dated Apr. 21, 2017.

* cited by examiner

LINEAR COMPRESSOR

CROSS-REFERENCE TO RELATED APPLICATION(S)

The present application claims priority under 35 U.S.C. 119 and 35 U.S.C. 365 to Korean Patent Application No. 10-2016-0052183, filed in Korea on Apr. 28, 2016, which is hereby incorporated by reference in its entirety.

BACKGROUND

1. Field

A linear compressor is disclosed herein.

2. Background

Cooling systems are systems in which a refrigerant circulates to generate cool air. In such a cooling system, processes of compressing, condensing, expanding, and evaporating the refrigerant are repeatedly performed. For this, the cooling system includes a compressor, a condenser, an expansion device, and an evaporator. Also, the cooling system may be installed in a refrigerator or air conditioner which is a home appliance.

In general, compressors are machines that receive power from a power generation device, such as an electric motor or a turbine, to compress air, a refrigerant, or various working gases, thereby increasing pressure. Compressors are being widely used in home appliances or industrial fields.

Compressors may be largely classified into reciprocating compressors, in which a compression space into/from which a working gas is suctioned and discharged, is defined between a piston and a cylinder to allow the piston to be linearly reciprocated into the cylinder, thereby compressing a refrigerant, rotary compressors, in which a compression space into/from which a working gas is suctioned or discharged, is defined between a roller that eccentrically rotates and a cylinder to allow the roller to eccentrically rotate along an inner wall of the cylinder, thereby compressing a refrigerant, and scroll compressors, in which a compression space into/from which a refrigerant is suctioned or discharged, is defined between an orbiting scroll and a fixed scroll to compress a refrigerant while the orbiting scroll rotates along the fixed scroll. In recent years, a linear compressor, which is directly connected to a drive motor, in which a piston linearly reciprocates, to improve compression efficiency without mechanical losses due to movement conversion, and having a simple structure, is being widely developed. In general, the linear compressor may suction and compress a refrigerant while a piston linearly reciprocates in a sealed shell by a linear motor and then discharge the refrigerant.

The linear motor is configured to allow a permanent magnet to be disposed between an inner stator and an outer stator. The permanent magnet may linearly reciprocate by an electromagnetic force between the permanent magnet and the inner (or outer) stator. Also, as the permanent magnet operates in the state in which the permanent magnet is connected to the piston, the permanent magnet may suction and compress the refrigerant while linearly reciprocating within the cylinder and then discharge the refrigerant.

The present applicant has filed a patent (hereinafter, referred to as "Prior Art Document 1") and then has registered the patent with respect to the linear compressor, Korean Patent Registration No. 10-1307688, registered on Sep. 5, 2013 and entitled "LINEAR COMPRESSOR", which is hereby incorporated by reference. The linear compressor according to the Prior Art Document 1 includes a shell for accommodating a plurality of parts. A vertical height of the shell may be somewhat high as illustrated in FIG. 2 of the Prior Art Document 1. Also, an oil supply assembly for supplying oil between a cylinder and a piston may be disposed within the shell.

When the linear compressor is provided in a refrigerator, the linear compressor may be disposed in a machine room provided at a rear side of the refrigerator. In recent years, a major concern of a customer is increasing an inner storage space of the refrigerator. To increase the inner storage space of the refrigerator, it may be necessary to reduce a volume of the machine room. Also, to reduce the volume of the machine room, it may be important to reduce a size of the linear compressor.

However, as the linear compressor disclosed in the Prior Art Document 1 has a relatively large volume, it is necessary to increase a volume of a machine room into which the linear compressor is accommodated. Thus, the linear compressor having a structure disclosed in the Prior Art Document 1 is not adequate for the refrigerator for increasing the inner storage space thereof.

To reduce the size of the linear compressor, it may be necessary to reduce a size of a main part or component of the compressor. In this case, performance of the compressor may deteriorate. To compensate for the deteriorated performance of the compressor, the compressor drive frequency may be increased. However, the more the drive frequency of the compressor is increased, the more a friction force due to oil circulating into the compressor increases, deteriorating performance of the compressor.

To solve these limitations, the present applicant has filed a patent application (hereinafter, referred to as "Prior Art Document 2"), Korean Patent Publication No. 10-2016-0000324 published on Jan. 4, 2016, and entitled "LINEAR COMPRESSOR". In the linear compressor of the Prior Art Document 2, a gas bearing technology in which a refrigerant gas is supplied in a space between a cylinder and a piston to perform a bearing function is disclosed.

In the linear compressor according to the Prior Art Document 2, a bearing space between the cylinder and the piston has a small size, to cause causing a limitation in which that an inflow of a refrigerant through a nozzle of the cylinder is not smooth. Thus, the refrigerant may be reduced in pressure, and thus, a lifting force of the piston due to the gas bearing may not be high. As a result, there is a limitation in which that a friction force between the reciprocating piston and the cylinder occurs.

Also, although the refrigerant has to be uniformly introduced over an outer circumferential surface of a piston body, a relatively large amount of gas bearing may be supplied to a position at which the refrigerant pressure is high, that is, a front side of the piston, and thus, the lifting force of the piston may be relatively low at a rear side of the piston. As a result, an unbalance in lifting force may occur between the front and rear sides of the piston, and thus, the gas bearing may be deteriorated in performance.

Also, the refrigerant gas used as the gas bearing may not be discharged to the inside of the shell, but flow to a compression space of the cylinder, and thus, be compressed again, thereby deteriorating the compression performance of the refrigerant.

BRIEF DESCRIPTION OF THE DRAWINGS

Embodiments will be described in detail with reference to the following drawings in which like reference numerals refer to like elements, and wherein.

DETAILED DESCRIPTION

Hereinafter, embodiments will be described with reference to the accompanying drawings. The embodiments may, however, be embodied in many different forms and should not be construed as being limited to the embodiments set forth herein; rather, that alternate embodiments included in other retrogressive inventions or falling within the spirit and scope will fully convey the concept to those skilled in the art.

Figure 1:
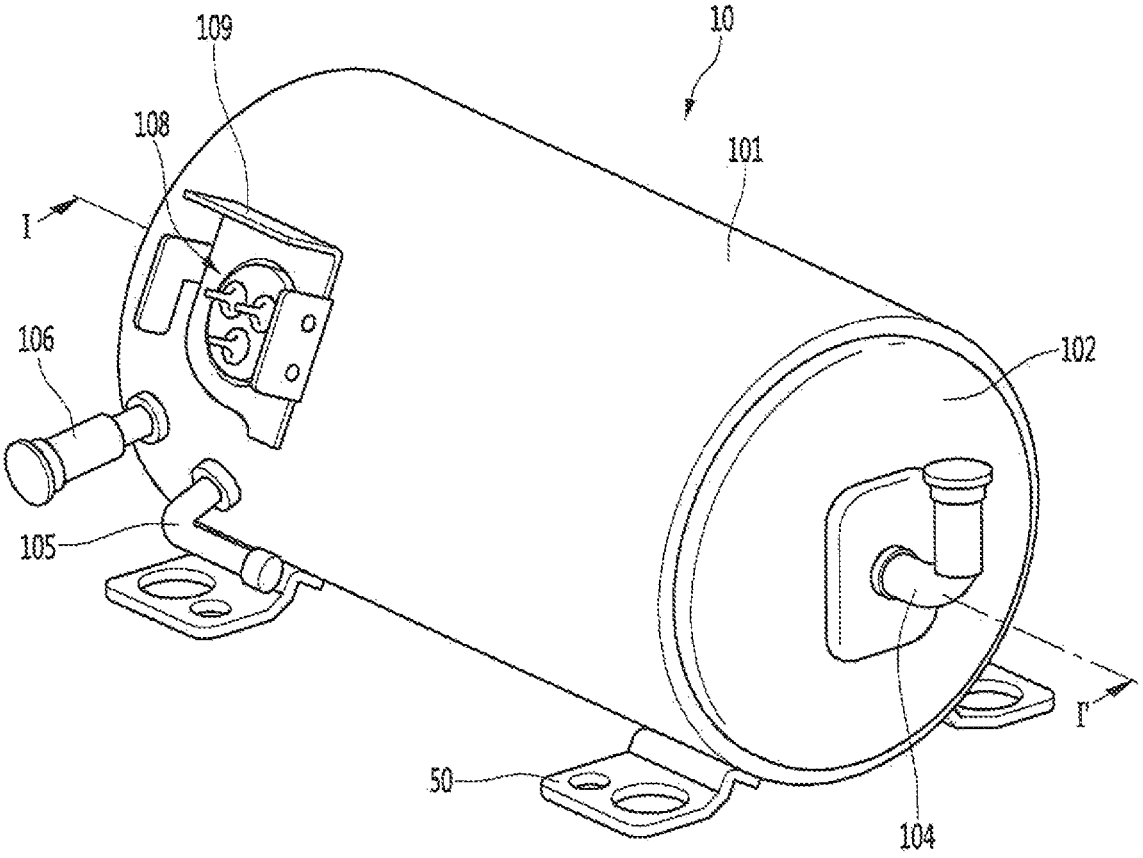
FIG. 1 is a perspective view illustrating an outer appearance of a linear compressor according to an embodiment.
Figure 2:
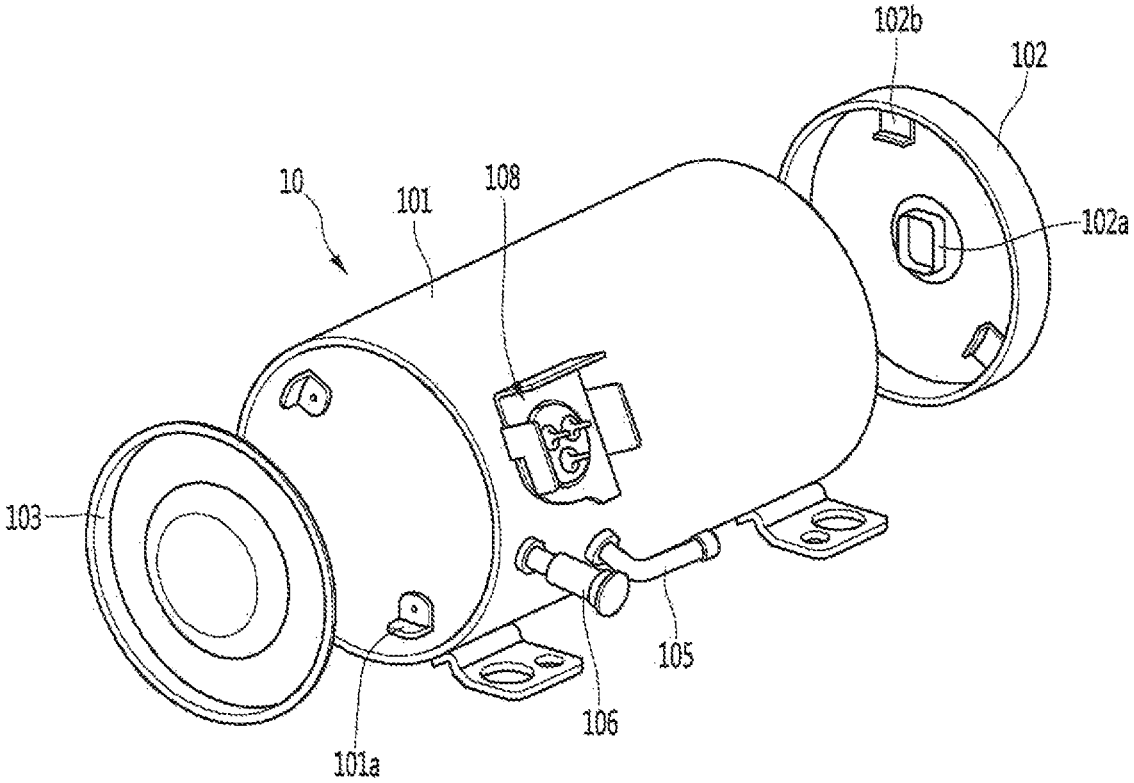
FIG. 2 is an exploded perspective view of a shell and a shell cover of the linear compressor according to an embodiment.

FIG. 1 is a perspective view illustrating an outer appearance of a linear compressor according to an embodiment. FIG. 2 is an exploded perspective view illustrating a shell and a shell cover of the linear compressor according to an embodiment.

Referring to FIGS. 1 and 2, a linear compressor 10 according to an embodiment may include a shell 101 and shell covers 102 and 103 coupled to the shell 101. Each of the first and second shell covers 102 and 103 may be understood as one component of the shell 101.

A leg 50 may be coupled to a lower portion of the shell 101. The leg 50 may be coupled to a base of a product in which the linear compressor 10 is installed or provided. For example, the product may include a refrigerator, and the base may include a machine room base of the refrigerator. For another example, the product may include an outdoor unit of an air conditioner, and the base may include a base of the outdoor unit.

The shell 101 may have an approximately cylindrical shape and be disposed to lie in a horizontal direction or an axial direction. In FIG. 1, the shell 101 may extend in the horizontal direction and have a relatively low height in a radial direction. That is, as the linear compressor 10 has a low height, when the linear compressor 10 is installed or provided in the machine room base of the refrigerator, a machine room may be reduced in height.

A terminal 108 may be installed or provided on an outer surface of the shell 101. The terminal 108 may be understood as a component for transmitting external power to a motor assembly (see reference numeral 140 of FIG. 3) of the linear compressor 10. The terminal 108 may be connected to a lead line of a coil (see reference numeral 141*c* of FIG. 3).

A bracket 109 may be installed or provided outside of the terminal 108. The bracket 109 may include a plurality of brackets that surrounds the terminal 108. The bracket 109 may protect the terminal 108 against an external impact.

Both sides of the shell 101 may be open. The shell covers 102 and 103 may be coupled to both open sides of the shell 101. The shell covers 102 and 103 may include a first shell cover 102 coupled to one open side of the shell 101 and a second shell cover 103 coupled to the other open side of the shell 101. An inner space of the shell 101 may be sealed by the shell covers 102 and 103.

In FIG. 1, the first shell cover 102 may be disposed at a first or right portion of the linear compressor 10, and the second shell cover 103 may be disposed at a second or left portion of the linear compressor 10. That is, the first and second shell covers 102 and 103 may be disposed to face each other.

The linear compressor 10 further includes a plurality of pipes 104, 105, and 106 provided in the shell 101 or the shell covers 102 and 103 to suction, discharge, or inject the refrigerant. The plurality of pipes 104, 105, and 106 may include a suction pipe 104 through which the refrigerant may be suctioned into the linear compressor 10, a discharge pipe 105 through which the compressed refrigerant may be discharged from the linear compressor 10, and a process pipe through which the refrigerant may be supplemented to the linear compressor 10.

For example, the suction pipe 104 may be coupled to the first shell cover 102. The refrigerant may be suctioned into the linear compressor 10 through the suction pipe 104 in an axial direction.

The discharge pipe 105 may be coupled to an outer circumferential surface of the shell 101. The refrigerant suctioned through the suction pipe 104 may flow in the axial direction and then be compressed. Also, the compressed refrigerant may be discharged through the discharge pipe 105. The discharge pipe 105 may be disposed at a position which is adjacent to the second shell cover 103 rather than the first shell cover 102.

The process pipe 106 may be coupled to the outer circumferential surface of the shell 101. A worker may inject the refrigerant into the linear compressor 10 through the process pipe 106.

The process pipe 106 may be coupled to the shell 101 at a height different from a height of the discharge pipe 105 to avoid interference with the discharge pipe 105. The height may be understood as a distance from the leg 50 in the vertical direction (or the radial direction). As the discharge pipe 105 and the process pipe 106 are coupled to the outer circumferential surface of the shell 101 at the heights different from each other, a worker's work convenience may be improved.

At least a portion of the second shell cover 103 may be disposed adjacent to an inner circumferential surface of the shell 101, which corresponds to a point to which the process pipe 106 may be coupled. That is, at least a portion of the second shell cover 103 may act as a flow resistance to the refrigerant injected through the process pipe 106.

Thus, in view of the passage of the refrigerant, the passage of the refrigerant introduced through the process pipe 106 may have a size that gradually decreases toward the inner space of the shell 101. In this process, a pressure of the refrigerant may be reduced to allow the refrigerant to be vaporized. Also, in this process, oil contained in the refrigerant may be separated. Thus, the refrigerant from which the oil is separated may be introduced into a piston 130 to improve compression performance of the refrigerant. The oil may be understood as a working oil existing in a cooling system.

A cover support part or support 102*a* may be disposed or provided on an inner surface of the first shell cover 102. A second support device or support 185, which will be described hereinafter, may be coupled to the cover support part 102*a*. The cover support part 102*a* and the second support device 185 may be understood as devices that support a main body of the linear compressor 10. The main body of the compressor may represent a part or portion provided in the shell 101. For example, the main body may include a drive part or drive that reciprocates forward and backward and a support part or support that supports the drive part. The drive part may include parts or components, such as the piston 130, a magnet frame 138, a permanent magnet 146, a support 137, and a suction muffler 150. Also, the support part may include parts or components, such as resonant springs 176*a* and 176*b*, a rear cover 170, a stator cover 149, a first support device or support 165, and a second support device or support 185.

A stopper 102*b* may be disposed or provided on the inner surface of the first shell cover 102. The stopper 102*b* may be understood as a component that prevents the main body of the compressor, particularly, the motor assembly 140 from being bumped by the shell 101 and thus damaged due to vibration or an impact occurring during transportation of the linear compressor 10. The stopper 102*b* may be disposed or provided adjacent to the rear cover 170, which will be described hereinafter. Thus, when the linear compressor 10 is shaken, the rear cover 170 may interfere with the stopper 102*b* to prevent the impact from being transmitted to the motor assembly 140.

A spring coupling part or portion 101*a* may be disposed or provided on the inner surface of the shell 101. For example, the spring coupling part 101*a* may be disposed at a position which is adjacent to the second shell cover 103. The spring coupling part 101*a* may be coupled to a first support spring 166 of the first support device 165, which will be described hereinafter. As the spring coupling part 101*a* and the first support device 165 are coupled to each other, the main body of the compressor may be stably supported inside of the shell 101.

Figure 3:
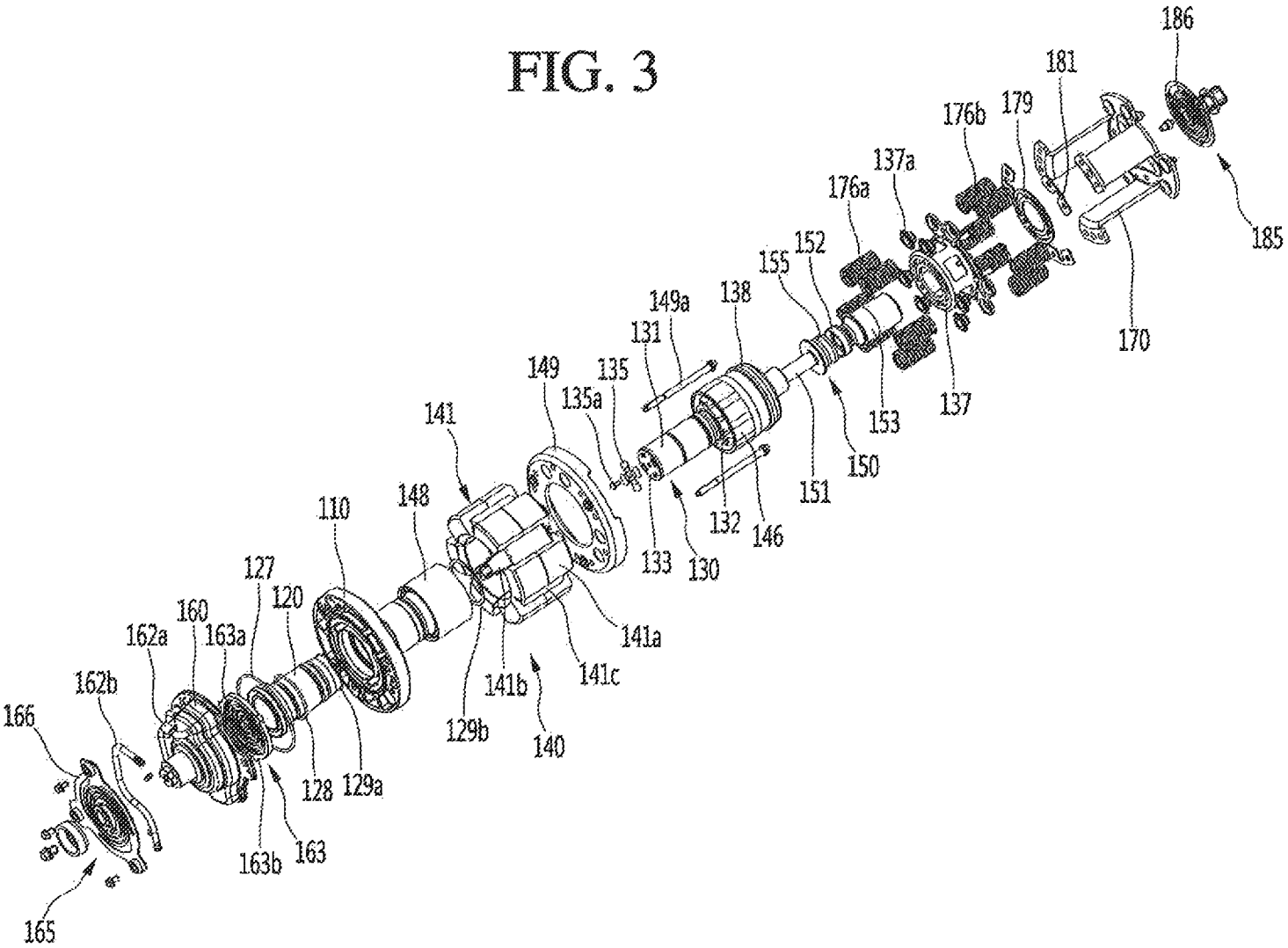
FIG. 3 is an exploded perspective view illustrating internal parts or components of the linear compressor according to an embodiment.
Figure 4:
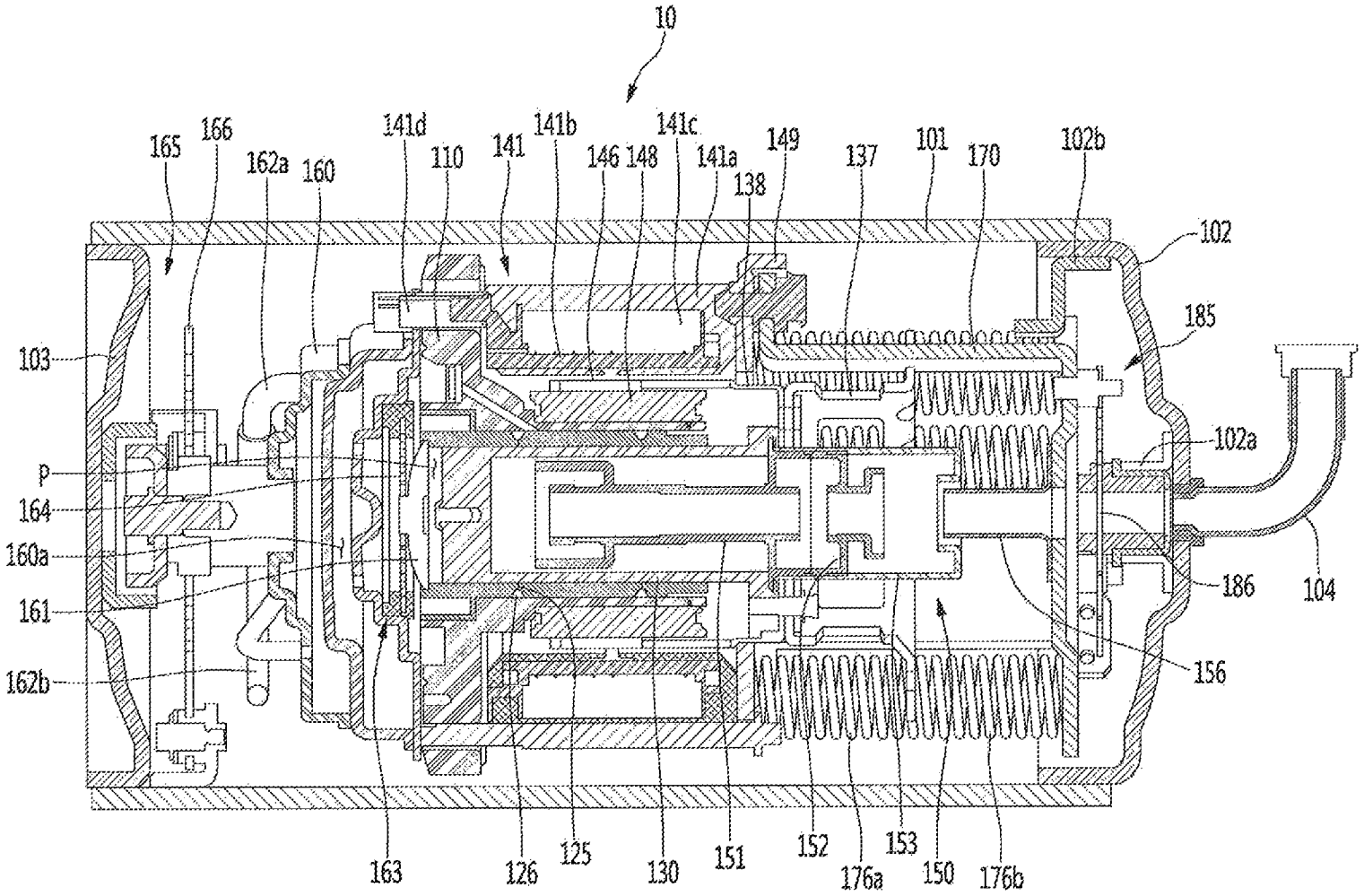
FIG. 4 is a cross-sectional view, taken along line I-I' of FIG. 1.

FIG. 3 is an exploded perspective view illustrating internal components of the linear compressor according to an embodiment. FIG. 4 is a cross-sectional view illustrating internal components of the linear compressor according to an embodiment.

Referring to FIGS. 3 and 4, the linear compressor 10 according to an embodiment may include a cylinder 120 provided in the shell 101, the piston 130, which linearly reciprocates within the cylinder 120, and the motor assembly 140, which functions as a linear motor to apply drive force to the piston 130. When the motor assembly 140 is driven, the piston 130 may linearly reciprocate in the axial direction.

The linear compressor 10 may further include a suction muffler 150 coupled to the piston 130 to reduce noise generated from the refrigerant suctioned through the suction pipe 104. The refrigerant suctioned through the suction pipe 104 may flow into the piston 130 via the suction muffler 150. For example, while the refrigerant passes through the suction muffler 150, the flow noise of the refrigerant may be reduced.

The suction muffler 150 may include a plurality of mufflers 151, 152, and 153. The plurality of mufflers 151, 152, and 153 may include a first muffler 151, a second muffler 152, and a third muffler 153, which may be coupled to each other.

The first muffler 151 may be disposed or provided within the piston 130, and the second muffler 152 may be coupled to a rear portion of the first muffler 151. Also, the third muffler 153 may accommodate the second muffler 152 therein and extend to a rear side of the first muffler 151. In view of a flow direction of the refrigerant, the refrigerant suctioned through the suction pipe 104 may successively pass through the third muffler 153, the second muffler 152, and the first muffler 151. In this process, the flow noise of the refrigerant may be reduced.

The suction muffler 150 may further include a muffler filter 155. The muffler filter 155 may be disposed on or at an interface on or at which the first muffler 151 and the second muffler 152 are coupled to each other. For example, the muffler filter 155 may have a circular shape, and an outer circumferential portion of the muffler filter 155 may be supported between the first and second mufflers 151 and 152.

The "axial direction" may be understood as a direction in which the piston 130 reciprocates, that is, a horizontal direction in FIG. 4. Also, "in the axial direction", a direction from the suction pipe 104 toward a compression space P, that is, a direction in which the refrigerant flows may be defined as a "frontward direction", and a direction opposite to the frontward direction may be defined as a "rearward direction". When the piston 130 moves forward, the compression space P may be compressed. On the other hand, the "radial direction" may be understood as a direction which is perpendicular to the direction in which the piston 130 reciprocates, that is, a vertical direction in FIG. 4.

The piston 130 may include a piston body 131 having an approximately cylindrical shape and a piston flange part or flange 132 that extends from the piston body 131 in the radial direction. The piston body 131 may reciprocate inside of the cylinder 120, and the piston flange part 132 may reciprocate outside of the cylinder 120.

The cylinder 120 may be configured to accommodate at least a portion of the first muffler 151 and at least a portion of the piston body 131. The cylinder 120 may have the compression space P in which the refrigerant may be compressed by the piston 130. Also, a suction hole 133, through which the refrigerant may be introduced into the compression space P, may be defined in a front portion of the piston body 131, and a suction valve 135 that selectively opens the suction hole 133 may be disposed or provided on a front side of the suction hole 133. A coupling hole, to which a predetermined coupling member 135*a* may be coupled, may be defined in an approximately central portion of the suction valve 135.

A discharge cover 160 that defines a discharge space 160*a* for the refrigerant discharged from the compression space P and a discharge valve assembly 161 and 163 coupled to the discharge cover 160 to selectively discharge the refrigerant compressed in the compression space P may be provided at a front side of the compression space P. The discharge space 160*a* may include a plurality of space parts or spaces which may be partitioned by inner walls of the discharge cover 160. The plurality of space parts may be disposed or provided in the frontward and rearward direction to communicate with each other.

The discharge valve assembly 161 and 163 may include a discharge valve 161 which may be opened when the pressure of the compression space P is above a discharge pressure to introduce the refrigerant into the discharge space 160*a* and a spring assembly 163 disposed or provided between the discharge valve 161 and the discharge cover 160 to provide an elastic force in the axial direction.

The spring assembly 163 may include a valve spring 163*a* and a spring support part or support 163*b* that supports the valve spring 163*a* to the discharge cover 160. For example, the valve spring 163*a* may include a plate spring. Also, the spring support part 163*b* may be integrally injection-molded to the valve spring 163*a* through an injection-molding process, for example.

The discharge valve 161 may be coupled to the valve spring 163*a*, and a rear portion or rear surface of the discharge valve 161 may be disposed to be supported on a front surface of the cylinder 120. When the discharge valve 161 is supported on the front surface of the cylinder 120, the compression space may be maintained in the sealed state. When the discharge valve 161 is spaced apart from the front surface of the cylinder 120, the compression space P may be opened to allow the refrigerant in the compression space P to be discharged.

The compression space P may be understood as a space defined between the suction valve 135 and the discharge valve 161. Also, the suction valve 135 may be disposed on or at one side of the compression space P, and the discharge valve 161 may be disposed on or at the other side of the compression space P, that is, an opposite side of the suction valve 135.

While the piston 130 linearly reciprocates within the cylinder 120, when the pressure of the compression space P is below the discharge pressure and a suction pressure, the suction valve 135 may be opened to suction the refrigerant into the compression space P. On the other hand, when the pressure of the compression space P is above the suction pressure, the suction valve 135 may compress the refrigerant of the compression space P in a state in which the suction valve 135 is closed.

When the pressure of the compression space P is above the discharge pressure, the valve spring 163*a* may be deformed forward to open the discharge valve 161. The refrigerant may be discharged from the compression space P into the discharge space 160*a* of the discharge cover 160. When the discharge of the refrigerant is completed, the valve spring 163*a* may provide a restoring force to the discharge valve 161 to close the discharge valve 161.

The linear compressor 10 may further include a cover pipe 162*a* coupled to the discharge cover 200 to discharge the refrigerant flowing through the discharge space of the discharge cover 200. For example, the cover pipe 162*a* may be made of a metal material.

Also, the linear compressor 10 may further include a loop pipe 162*b* coupled to the cover pipe 162*a* to transfer the refrigerant flowing through the cover pipe 162*a* to the discharge pipe 105. The loop pipe 162*b* may have one or a first side or end coupled to the cover pipe 162*a* and the other or a second side or end coupled to the discharge pipe 105.

The loop pipe 162*b* may be made of a flexible material and have a relatively long length. Also, the loop pipe 162*b* may roundly extend from the cover pipe 162*a* along the inner circumferential surface of the shell 101 and be coupled to the discharge pipe 105. For example, the loop pipe 162*b* may have a wound shape.

The linear compressor 10 may further include a frame 110. The frame 110 is understood as a component that fixes the cylinder 120. For example, the cylinder 120 may be press-fitted into the frame 110. Each of the cylinder 120 and the frame 110 may be made of aluminum or an aluminum alloy material, for example.

The frame 110 may be disposed or provided to surround the cylinder 120. That is, the cylinder 120 may be disposed or provided to be accommodated into the frame 110. Also, the discharge cover 200 may be coupled to a front surface of the frame 110 using a coupling member.

The motor assembly 140 may include an outer stator 141 fixed to the frame 110 and disposed or provided to surround the cylinder 120, an inner stator 148 disposed or provided to be spaced inward from the outer stator 141, and the permanent magnet 146 disposed or provided in a space between the outer stator 141 and the inner stator 148.

The permanent magnet 146 may be linearly reciprocated by mutual electromagnetic force between the outer stator 141 and the inner stator 148. Also, the permanent magnet 146 may be provided as a single magnet having one polarity or by coupling a plurality of magnets having three polarities to each other.

A magnet frame 138 may be installed or provided on the permanent magnet 146. The magnet frame 138 may have an approximately cylindrical shape and be disposed or provided to be inserted into the space between the outer stator 141 and the inner stator 148.

Referring to the cross-sectional view of FIG. 4, the magnet frame 138 may be coupled to the piston flange part 132 to extend in an outer radial direction and then be bent forward. The permanent magnet 146 may be installed or provided on a front portion of the magnet frame 138. When the permanent magnet 146 reciprocates, the piston 130 may reciprocate together with the permanent magnet 146 in the axial direction.

The outer stator 141 may include coil winding bodies 141*b*, 141*c*, and 141*d*, and a stator core 141*a*. The coil winding bodies 141*b*, 141*c*, and 141*d* may include a bobbin 141*b* and a coil 141*c* wound in a circumferential direction of the bobbin 141*b*. The coil winding bodies 141*b*, 141*c*, and 141*d* may further include a terminal part or portion 141*d* that guides a power line connected to the coil 141*c* so that the power line is led out or exposed to the outside of the outer stator 141.

The stator core 141*a* may include a plurality of core blocks in which a plurality of laminations are laminated in a circumferential direction. The plurality of core blocks may be disposed or provided to surround at least a portion of the coil winding bodies 141*b* and 141*c*.

A stator cover 149 may be disposed or provided on one or a first side of the outer stator 141. That is, the outer stator 141 may have one or a first side supported by the frame 110 and the other or a second side supported by the stator cover 149.

The linear compressor 10 may further include a cover coupling member 149*a* that couples the stator cover 149 to the frame 110. The cover coupling member 149*a* may pass through the stator cover 149 to extend forward to the frame 110 and then be coupled to a first coupling hole (see reference numeral 119*a* of FIG. 6) of the frame 110.

The inner stator 148 may be fixed to a circumference of the frame 110. Also, in the inner stator 148, the plurality of laminations may be laminated in the circumferential direction outside of the frame 110.

The linear compressor 10 may further include a support 137 that supports the piston 130. The support 137 may be coupled to a rear portion of the piston 130, and the muffler 150 may be disposed or provided to pass through the inside of the support 137. The piston flange part 132, the magnet frame 138, and the support 137 may be coupled to each other using a coupling member.

A balance weight 179 may be coupled to the support 137. A weight of the balance weight 179 may be determined based on a drive frequency range of the compressor body.

The linear compressor 10 may further include a rear cover 170 coupled to the stator cover 149 to extend backward and supported by the second support device 185. The rear cover 170 may include three support legs, and the three support legs may be coupled to a rear surface of the stator cover 149. A spacer 181 may be disposed or provided between the three support legs and the rear surface of the stator cover 149. A distance from the stator cover 149 to a rear end of the rear cover 170 may be determined by adjusting a thickness of the spacer 181. Also, the rear cover 170 may be spring-supported by the support 137.

The linear compressor 10 may further include an inflow guide part or guide 156 coupled to the rear cover 170 to guide an inflow of the refrigerant into the muffler 150. At least a portion of the inflow guide part 156 may be inserted into the suction muffler 150.

The linear compressor 10 may further include a plurality of resonant springs 176*a* and 176*b* which may be adjusted in natural frequency to allow the piston 130 to perform a resonant motion. The plurality of resonant springs 176*a* and 176*b* may include a first resonant spring 176*a* supported between the support 137 and the stator cover 149 and a second resonant spring 176*b* supported between the support 137 and the rear cover 170. The drive part that reciprocates within the linear compressor 10 may be stably moved by the action of the plurality of resonant springs 176*a* and 176*b* to reduce vibration or noise due to the movement of the drive part. The support 137 may include a first spring support part or support 137*a* coupled to the first resonant spring 176*a*.

The linear compressor 10 may include the frame 110 and a plurality of sealing members or seals 127, 128, 129*a*, and 129*b* that increases a coupling force between peripheral parts or components around the frame 110. The plurality of sealing members 127, 128, 129*a*, and 129*b* may include a first sealing member or seal 127 disposed or provided at a portion at which the frame 110 and the discharge cover 160 are coupled to each other. The first sealing member 127 may be disposed or provided on or in a second installation groove (see reference numeral 116*b* of FIG. 6) of the frame 110.

The plurality of sealing members 127, 128, 129*a*, and 129*b* further include a second sealing member or seal 128 disposed or provided at a portion at which the frame 110 and the cylinder 120 are coupled to each other. The second sealing member 128 may be disposed or provided on or in a first installation groove (see reference numeral 116*a* of FIG. 6) of the frame 110.

The plurality of sealing members 127, 128, 129*a*, and 129*b* may further include a third sealing member or seal 129*a* disposed or provided between the cylinder 120 and the frame 110. The third sealing member 129*a* may be disposed or provided on or in a cylinder groove (see reference numeral 121*e* of FIG. 12) defined in the rear portion of the cylinder 120. The third sealing member 129*a* may prevent the refrigerant within a gas pocket (see reference numeral 110*b* of FIG. 13) disposed or provided between the an inner circumferential surface of the frame 110 and an outer circumferential surface of the cylinder 120 from leaking to the outside to increase a coupling force between the frame 110 and the cylinder 120.

The plurality of sealing members 127, 128, 129*a*, and 129*b* may further include a fourth sealing member or seal 129*b* disposed or provided at a portion at which the frame 110 and the inner stator 148 are coupled to each other. The fourth sealing member 129*b* may be disposed or provided on or in a third installation groove (see reference numeral 111*a* of FIG. 10) of the frame 110.

Each of the first to fourth sealing members 127, 128, 129*a*, and 129*b* may have a ring shape.

The linear compressor 10 may further include a first support device or support 165 coupled to the discharge cover 160 to support one or a first side of the main body of the compressor 10. The first support device 165 may be disposed or provided adjacent to the second shell cover 103 to elastically support the main body of the compressor 10. The first support device 165 may include a first support spring 166. The first support spring 166 may be coupled to the spring coupling part 101*a*.

The linear compressor 10 may further include a second support device or support 185 coupled to the rear cover 170 to support the other or a second side of the main body of the compressor 10. The second support device 185 may be coupled to the first shell cover 102 to elastically support the main body of the compressor 10. The second support device 185 includes a second support spring 186. The second support spring 186 may be coupled to the cover support part 102*a*.

Figure 5:
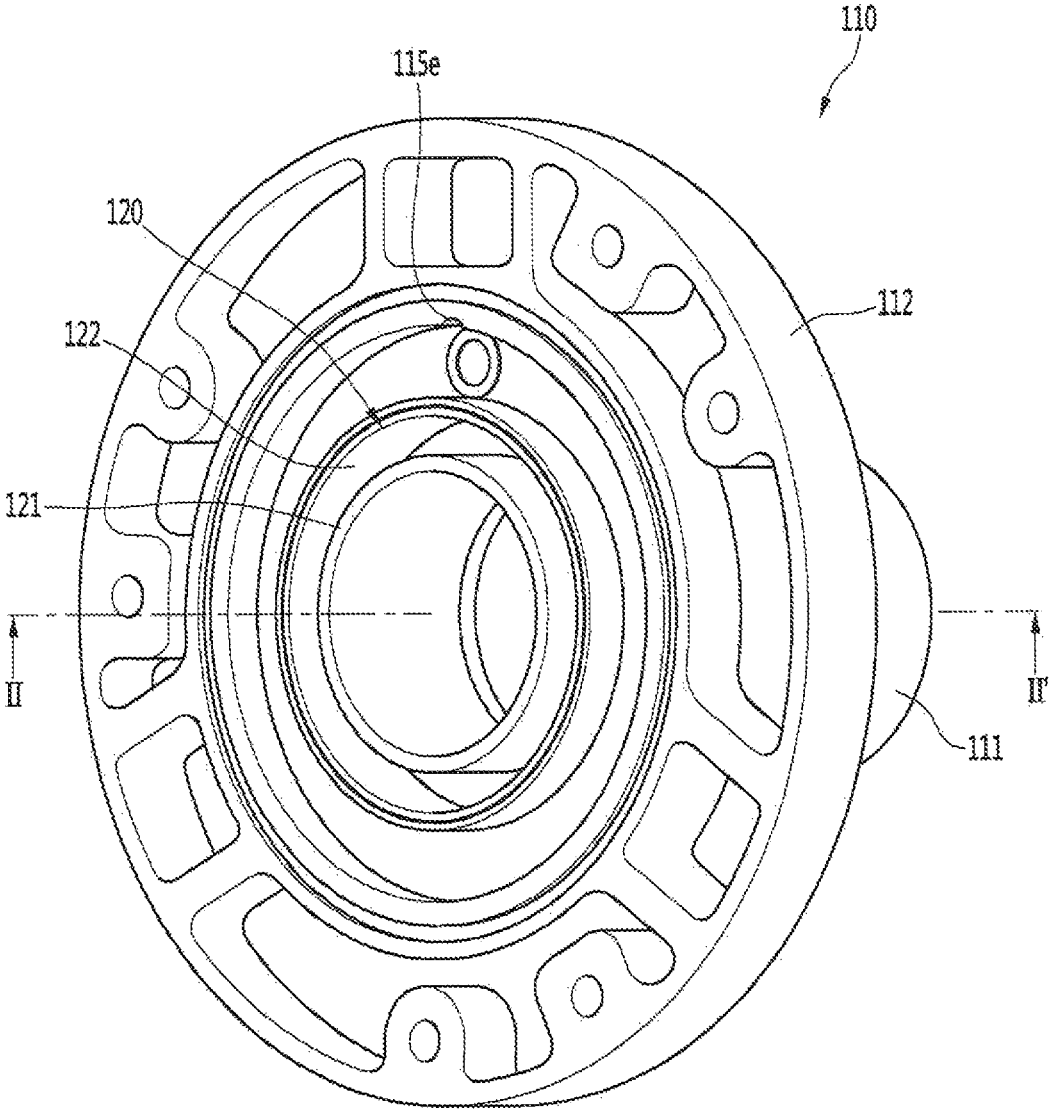
FIG. 5 is a perspective view of a state in which a frame and a cylinder are coupled to each other according to an embodiment.
Figure 6:
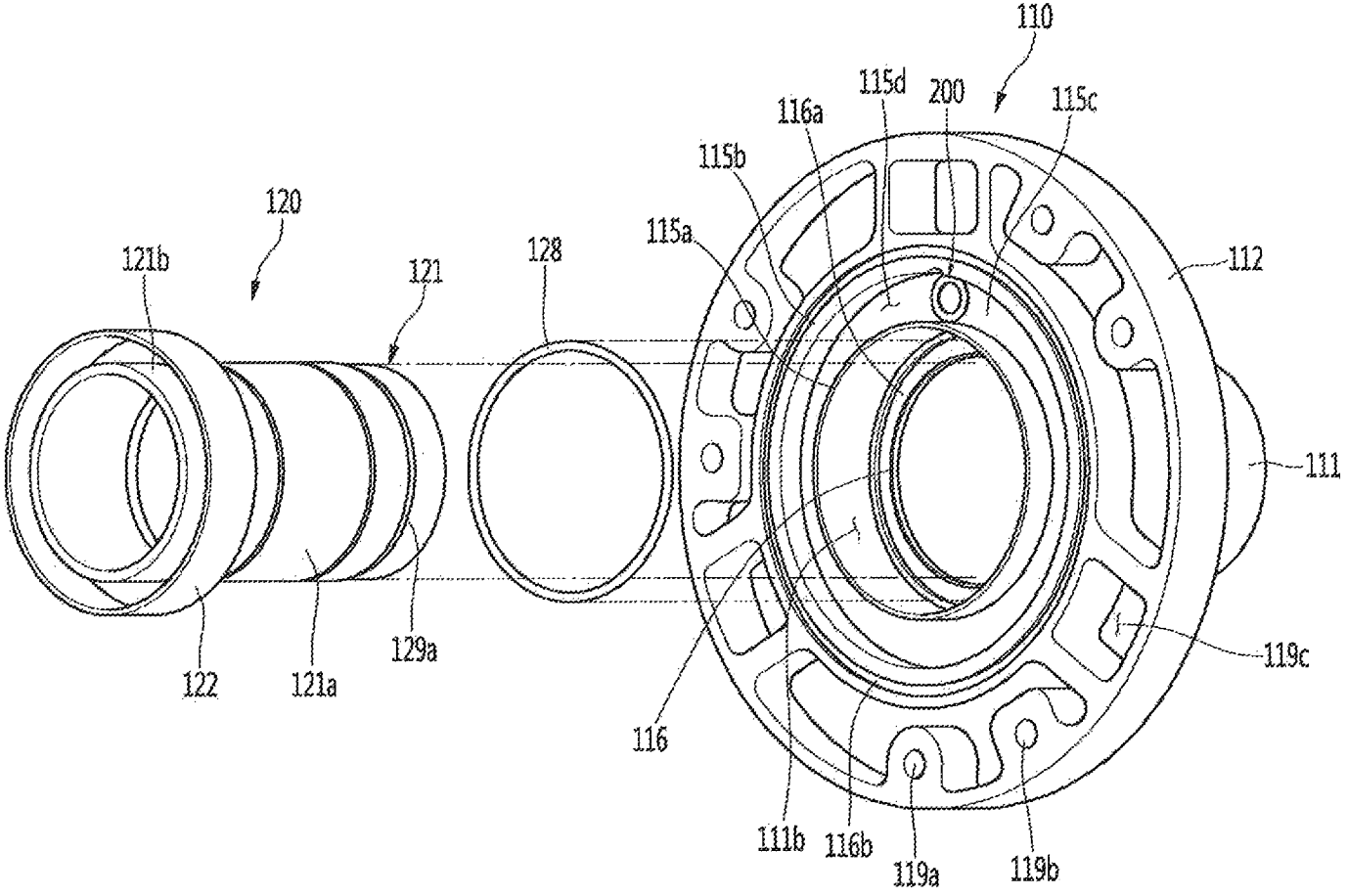
FIG. 6 is an exploded perspective view illustrating components of the frame and the cylinder according to an embodiment.
Figure 7:
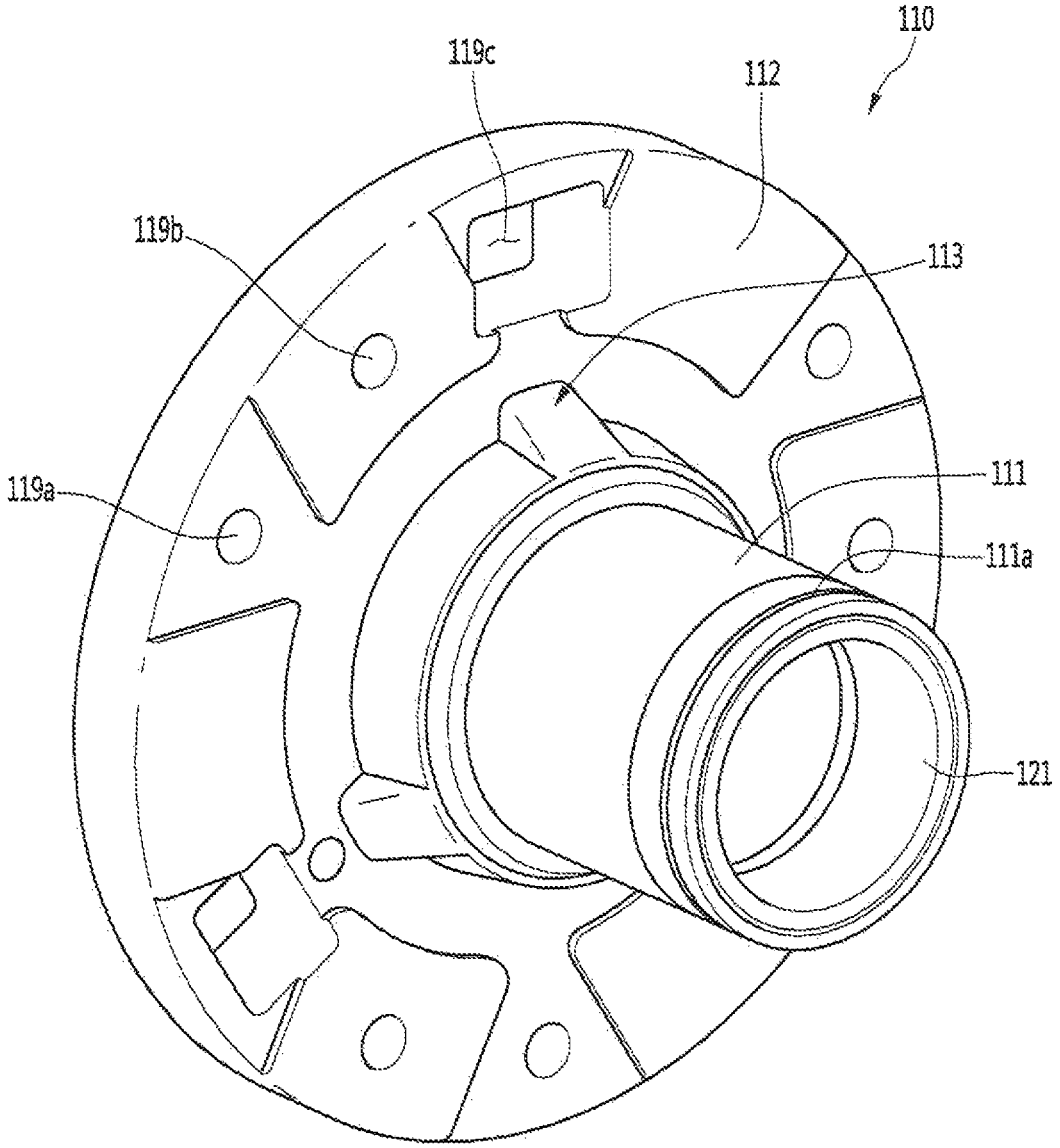
FIG. 7 is a perspective view illustrating a state in which the frame and the cylinder are coupled to each other according to an embodiment.
Figure 8:
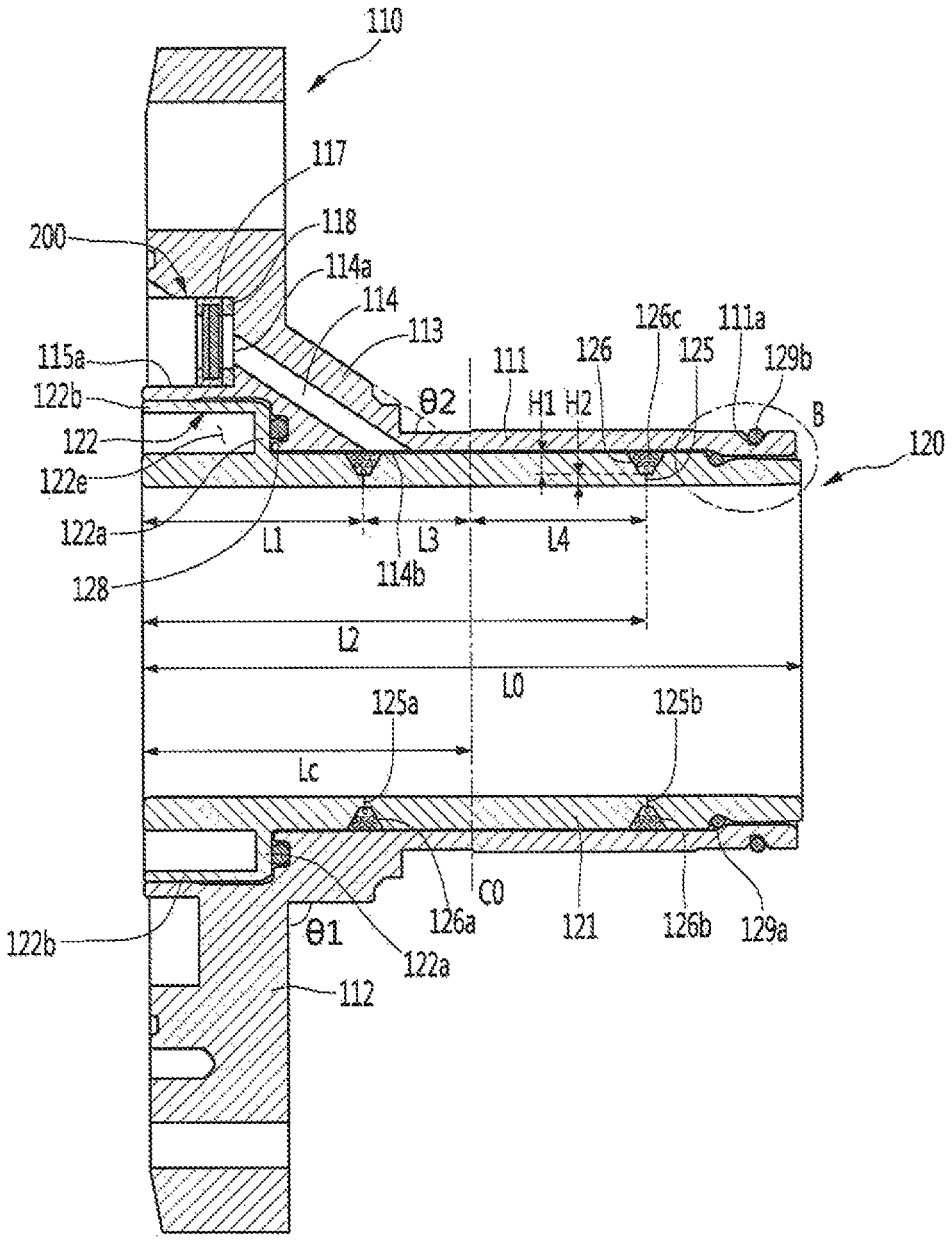
FIG. 8 is a cross-sectional view illustrating a state in which the frame and the cylinder are coupled to each other according to an embodiment, taken along line II-II' of FIG. 5.

FIG. 5 is a perspective view of a state in which the frame and the cylinder are coupled to each other according to an embodiment. FIG. 6 is an exploded perspective view illustrating components of the frame and the cylinder according to an embodiment. FIG. 7 is a perspective view illustrating a state in which the frame and the cylinder are coupled to each other according to an embodiment. FIG. 8 is a cross-sectional view illustrating a state in which the frame and the cylinder are coupled to each other according to an embodiment, taken along line II-II' of FIG. 5.

Referring to FIGS. 5 to 8, the cylinder 120 according to an embodiment may be coupled to the frame 110. For example, the cylinder 120 may be inserted into the frame 110.

The frame 110 may include a frame body 111 that extends in the axial direction and a frame flange 112 that extends outward from the frame body 111 in the radial direction. That is, the frame flange 112 may extend from an outer circumferential surface of the frame body 111 at a first preset or predetermined angle (θ1). For example, the first preset angle θ1 may be about 90°.

The frame body 111 may include a main body accommodation part or portion having a cylindrical shape with a central axis or central longitudinal axis in the axial direction and accommodating the cylinder body 121 therein. A third installation groove 111*a* in which a fourth sealing member or seal 129*b* may be inserted between the frame body 111 and the inner stator 148 may be defined in or at a rear portion of the frame body 111.

The frame flange 112 may include a first wall 115*a* having a ring shape and coupled to the cylinder flange 122, a second wall 115*b* having a ring shape and disposed or provided to surround the first wall 115*a*, and a third wall 115*c* that connects a rear end of the first wall 115*a* to a rear end of the second wall 115*b*. Each of the first wall 115*a* and the second wall 115*b* may extend in the axial direction, and the third wall 115*c* may extend in the radial direction. Thus, a frame space part or space 115*d* may be defined by the first to third walls 115*a*, 115*b*, and 115*c*. The frame space part 115*d* may be recessed backward from a front end of the frame flange 112 to form a portion of the discharge passage through which the refrigerant discharged through the discharge valve 161 may flow. A second installation groove 116*b* defined in a front end of the second wall 115*b* and in which the first sealing member 127 may be installed may be defined in the frame flange 112.

A cylinder accommodation part or portion 111*b*, into which at least a portion of the cylinder 120, for example, the cylinder flange 122 may be inserted, may be defined in an inner space of the first wall 115*a*. For example, the cylinder accommodation part 111*b* may have an inner diameter equal to or less than an outer diameter of the cylinder flange 122.

When the cylinder 120 is press-fitted into the frame 110, the cylinder flange 122 may interfere with the first wall 115*a*. In this process, the cylinder flange 122 may be deformed.

The frame flange 112 may further include a sealing member seating part or seat 116 that extends inward from a rear end of the first wall 115*a* in the radial direction. A first installation groove 116*a*, into which the second sealing member 128 may be inserted, may be defined in the sealing member seating part 116. The first installation groove 116*a* may be recessed backward from the sealing member seating part 116.

The frame flange 112 may further include coupling holes 119*a* and 119*b* to which a predetermined coupling member that couples the frame 110 to peripheral parts or components may be coupled. A plurality of the coupling holes 119*a* and 119*b* may be provided along an outer circumference of the second wall 115*a*.

The coupling holes 119*a* and 119*b* may include a first coupling hole 119*a* to which the cover coupling member 149*a* may be coupled. A plurality of the first coupling hole 119*a* may be provided, and the plurality of first coupling holes 119*a* may be disposed or provided to be spaced apart from each other. For example, three first coupling holes 119*a* may be provided.

The coupling holes 119*a* and 119*b* may further include a second coupling hole 119*b* to which a predetermined coupling member that couples the discharge cover 160 to the frame 110 may be coupled. A plurality of the second coupling hole 119*b* may be provided, and the plurality of second coupling holes 119*b* may be disposed or provided to be spaced apart from each other. For example, three second coupling holes 119*b* may be provided.

As the three first coupling holes 119*a* and the three second coupling holes 119*b* may be defined along the outer circumference of the frame flange 112, that is, uniformly defined in a circumferential direction with respect to a central portion in the axial direction of the frame 110, the frame 110 may be supported at three points of the peripheral parts or components, that is, the stator cover 149 and the discharge cover 160, and thus, stably coupled.

The frame flange 112 may include a terminal insertion part or portion 119*c* that provides a withdrawing path of a terminal part or portion 141*d* of the motor assembly 140. The terminal part 141*d* may extend forward from the coil 141*c* and be inserted into the terminal insertion part 119*c*. Thus, the terminal part 141*d* may be exposed to the outside from the motor assembly 140 and the frame 110 and connected to a cable which is directed to the terminal 108.

A plurality of the terminal insertion part 119*c* may be provided. The plurality of terminal insertion parts 119*c* may be disposed or provided along the outer circumference of the second wall 115*b*. Only one terminal insertion part 119*c*, into which the terminal part 141*d* may be inserted, of the plurality of terminal insertion parts 119*c* may be provided. The remaining terminal insertion parts 119*c* may be understood as components that prevent the frame 110 from being deformed.

For example, three terminal insertion parts 119*c* may be provided in the frame flange 112. In the three terminal insertion parts 119*c*, the terminal part 141*d* may be inserted into one terminal insertion part 119*c*, and the terminal part 141*d* may not be inserted into the remaining two terminal insertion parts 119*c*.

When the frame 110 is coupled to the stator cover 149 or the discharge cover 160 or press-fitted with respect to the cylinder 120, a large stress may be applied to the frame 110. When one terminal insertion part 119*c* is provided in the frame flange 112, the stress may be concentrated to or at a specific point, causing deformation of the frame flange 112. Thus, in this embodiment, the three terminal insertion parts 119*c* may be provided in the frame flange 112, that is, uniformly disposed or provided in the circumferential direction with respect to the central portion in the axial direction of the frame 110 to prevent the stress from being concentrated.

The frame 110 may further include a frame extension part or extension 113 that extends at an incline from the frame flange 112 to the frame body 111. An outer surface of the frame extension part 113 may extend at a second preset or predetermined angle (θ2) with respect to the outer circumferential surface of the frame body 111, that is, in the axial direction. For example, the second preset angle θ2 may be greater than about 0° and less than about 90°.

A gas hole 114 that guides the refrigerant discharged from the discharge valve 161 to a gas inflow part or inflow 126 of the cylinder 120 may be defined in the frame connection part 113. The gas hole 114 may pass through an inside of the frame connection part 113.

The gas hole 114 may extend from the frame flange 112 up to the frame body 111 via the frame connection part 113. As the gas hole 114 may be defined by passing through a portion of the frame having a relatively thick thickness up to the frame flange 112, the frame connection part 113, and the frame body 111, the frame 110 may be prevented from being reduced in strength due to the formation of the gas hole 114. An extension direction of the gas hole 114 may correspond to an extension direction of the frame connection part 113 to form the second preset angle θ2 with respect to the inner circumferential surface of the frame body 111, that is, in the axial direction.

A discharge filter 200 that filters foreign substances from the refrigerant introduced into the gas hole 114 may be disposed or provided on or at an inlet part or inlet 114*a* of the gas hole 114. The discharge filter 200 may be installed or provided on the third wall 115*c*.

The discharge filter 200 may be installed or provided on or in a filter groove 117 defined in the frame flange 112. The filter groove 117 may be recessed backward from the third wall 115*c* and have a shape corresponding to a shape of the discharge filter 200.

That is, the inlet part 114*a* of the gas hole 114 may be connected to the filter groove 117, and the gas hole 114 may pass through the frame flange 112 and the frame connection part 113 from the filter groove 117 to extend to the inner circumferential surface of the frame body 111. Thus, an outlet part or outlet 114*b* of the gas hole 114 may communicate with the inner circumferential surface of the frame body 111.

The linear compressor 10 may further include a filter sealing member or seal 118 installed or provided at a rear side, that is, an outlet side of the discharge filter 200. Each of the filter sealing members 118 may have an approximately ring shape. The filter sealing member 118 may be placed on or in the filter groove 117. When the discharge filter 200 presses the filter groove 117, the filter sealing member 118 may be press-fitted into the filter groove 117.

A plurality of the frame connection part 113 may be provided along a circumference of the frame body 111. Only one frame connection part 113, in which the gas hole 114 may be defined, of the plurality of frame connection parts 113 may be provided. The remaining frame connection parts 113 may be understood as components that prevent the frame 110 from being deformed.

When the frame 110 is coupled to the stator cover 149 or the discharge cover 160 or when the cylinder 120 is press-fitted into the frame 110, a large stress may be applied to the frame 110. When one frame connection part 113 is provided in the frame 110, the stress may be concentrated to or at a specific point, causing deformation of the frame 110. Thus, in this embodiment, the three frame connection parts 113 may be provided outside of the frame body 111, that is, uniformly disposed or provided in the circumferential direction with respect to the central portion in the axial direction of the frame 110 to prevent the stress from being concentrated.

That is, the cylinder 120 may be coupled to the inside of the frame 110. For example, the cylinder 120 may be coupled to the frame 110 through a press-fitting process.

The cylinder 120 may include a cylinder body 121 that extends in the axial direction and a cylinder flange 122 disposed or provided outside of a front portion of the cylinder body 121. The cylinder body 121 may have a cylindrical shape with a central axis or central longitudinal axis in the axial direction and be inserted into the frame body 111. Thus, an outer circumferential surface of the cylinder body 121 may be disposed or provided to face an inner circumferential surface of the frame body 111.

A gas inflow part or inflow 126 into which the gas refrigerant flowing through the gas hole 114 may be introduced may be provided in the cylinder body 121. The linear compressor 10 may further include a gas pocket 110*b* disposed or provided between the inner circumferential surface of the frame 110 and the outer circumferential surface of the cylinder 120 so that the gas used as the bearing may flow. A cooling gas passage from the outlet part 114*b* of the gas hole 114 to the gas inflow part 126 may define at least a portion of the gas pocket 110*b*. Also, the gas inflow part 126 may be disposed or provided at an inlet side of a cylinder nozzle 125, which will be described hereinafter.

The gas inflow part 126 may be recessed inward from the outer circumferential surface of the cylinder body 121 in the radial direction. Also, the gas inflow part 126 may have a circular shape along the outer circumferential surface of the cylinder body 121 with respect to the central axis in the axial direction.

A plurality of the gas inflow part 126 may be provided. For example, two gas inflow parts 126 may be provided. A first gas inflow part or inflow 126*a* of the two gas inflow parts 126 may be disposed or provided on or at a front portion of the cylinder body 121, that is, at a position which is close to the discharge valve 161, and a second gas inflow part or inflow 126*b* may be disposed or provided on or at a rear portion of the cylinder body 121, that is, at a position which is close to a compressor suction side of the refrigerant. That is, the first gas inflow part 126*a* may be disposed or provided at a front side with respect to a central portion Co in the axial direction of the cylinder body 121, and the second gas inflow part 126*b* may be disposed or provided at a rear side. Also, a first nozzle part or nozzle 125*a* connected to the first gas inflow part 126*a* may be disposed or provided at a front side with respect to the central portion Co, and a second nozzle part or nozzle 125*b* connected to the second gas inflow part 126*b* may be disposed or provided at a rear side with respect to the central portion Co.

The first gas inflow part 126*a* or the first nozzle part 125*a* may be disposed at a position which is spaced a first distance L1 from the front end of the cylinder body 121. Also, each of the second gas inflow part 126*b* or the second nozzle part 125*b* may be disposed or provided at a position which is spaced a second distance L2 from the front end of the cylinder body 121. The second distance L2 may be greater than the first distance L1. A third distance Lc from the front end of the cylinder body 121 to the central portion Co may be greater than the first distance L1 and less than the second distance L2. A fourth distance L3 from the central portion Co to the first gas inflow part 126*a* or the first nozzle part 125*a* may be determined as a value which is less than a fifth distance L4 from the central portion Co to the second gas inflow part 126*b* or the second nozzle part 125*b*.

When a length of the cylinder 120 in the frontward and rearward direction is Lo, a distance from the front end of the cylinder 120 to the first gas inflow part 126*a* may be L1, and a distance from the front end of the cylinder 120 to the second gas inflow part 126*b* may be L2. Positions of the first and second gas inflow parts 126*a* and 126*b* may be determined within the following range. For example, L1/Lo may be determined within a range of about 0.33 to about 0.43, and L2/Lo may be determined within a range of about 0.68 to about 0.86.

In the range of L1 and L2, a range of a flow rate of the refrigerant used as the gas bearing may satisfy a range of about 250 ml/min to about 350 ml/min. A flow rate condition may be a predetermined condition for improving an effect of the gas bearing.

If a flow rate condition which is less than the range of the flow rate of the refrigerant is formed, it is difficult to provide a sufficient lifting force for lifting the piston 130 within the cylinder 120. On the other hand, if a flow rate condition which is greater than the range of the flow rate of the refrigerant is formed, an amount of refrigerant used as the gas bearing may be too much, deteriorating a compression efficiency. Thus, in this embodiment, the positions of the first and second gas inflow parts 126*a* and 126 are set as described above to solve the above-described limitation.

The first gas inflow part 126*a* may be disposed or provided at a position which is adjacent to the outlet part 115*b* of the gas hole 114. That is, a distance from the outlet part

114*b* of the gas hole 114 to the first gas inflow part 126*a* may be less than a distance from the outlet part 114*b* to the second gas inflow part 126*b*.

An internal pressure of the cylinder 120 may be relatively high at a position which is close to the discharge side of the refrigerant, that is, an inside of the first gas inflow part 126*a*. Thus, the outlet part 114*b* of the gas hole 114 may be disposed or provided adjacent to the first gas inflow part 126*a*, and the first gas inflow part 126*a* may be disposed or provided adjacent to the central portion Co so that a relatively large amount of refrigerant may be introduced into the central portion of the inside of the cylinder 120 through the first gas inflow part 126*a*. As a result, the function of the gas bearing may be enhanced. Also, while the piston 130 reciprocates, abrasion between the cylinder 120 and the piston 130 may be prevented.

A cylinder filter member or filter 126*c* may be installed or provided on or at the gas inflow part 126. The cylinder filter member 126*c* may prevent a foreign substance having a predetermined size or more from being introduced into the cylinder 120 and perform a function of absorbing oil contained in the refrigerant. The predetermined size may be about 1 μm.

The cylinder filter member 126*c* may include a thread which is wound around the gas inflow part 126. The thread may be made of a polyethylene terephthalate (PET) material and have a predetermined thickness or diameter.

The thickness or diameter of the thread may be determined to have adequate dimensions in consideration of a strength of the thread. If the thickness or diameter of the thread is too small, the thread may be easily broken due to a very weak strength thereof. On the other hand, if the thickness or diameter of the thread is too large, a filtering effect with respect to the foreign substances may be deteriorated due to a very large pore in the gas inflow part 126 when the thread is wound.

The cylinder body 121 may further include a cylinder nozzle 125 that extends inward from the gas inflow part 126 in the radial direction. The cylinder nozzle 125 may extend up to the inner circumferential surface of the cylinder body 121.

A length H2 in the radial direction of the cylinder nozzle 125 may be less than a length H1, that is, a recessed depth of the gas inflow part 126 in the radial direction. Also, the inner space of the cylinder nozzle 125 may have a volume less than a volume of the gas inflow part 126.

The recessed depth and width of the gas inflow part 126 and the length of the cylinder nozzle 125 may be determined to have adequate dimensions in consideration of a rigidity of the cylinder 120, an amount of cylinder filter member 126*c*, or an intensity in pressure drop of the refrigerant passing through the cylinder nozzle 125. For example, if the recessed depth and width of the gas inflow part 126 are very large, or the length of the cylinder nozzle 125 is very short, the rigidity of the cylinder 120 may be weak. On the other hand, if the recessed depth and width of each of the gas inflow part 126 are very small, an amount of cylinder filter member 126*c* installed or provided on or in the gas inflow part 126 may be very small. Also, if the length H2 of the cylinder nozzle 125 is too long, the pressure drop of the refrigerant passing through the nozzle part 123 may be too large, and it may be difficult to perform a sufficient function as the gas bearing.

In this embodiment, a ratio of the length H2 of the cylinder nozzle 125 to the length H1 of the gas inflow part 126 may be within to a range of about 0.65 to about 0.75. An effect of the gas bearing may be improved within the above-described ratio range, and the rigidity of the cylinder 120 may be maintained to a desired level.

An inlet part or inlet of the cylinder nozzle 125 may have a diameter greater than a diameter of an outlet part or outlet thereof. In a flow direction of the refrigerant, a flow sectional area of the cylinder nozzle 125 may gradually decrease from the inlet part 123*a* to the outlet part 123*b*. The inlet part may be understood as a portion connected to the gas inflow part 126 to introduce the refrigerant into the cylinder nozzle 125, and the outlet part may be understood as a portion connected to the inner circumferential surface of the cylinder 120 to supply the refrigerant to the outer circumferential surface of the piston 130.

If the diameter of the cylinder nozzle 125 is too small, an amount of refrigerant, which is introduced from the cylinder nozzle 125, of the high-pressure gas refrigerant discharged through the discharge valve 161 may be too large, increasing a flow loss in the compressor. On the other hand, if the diameter of the cylinder nozzle 125 is too small, a pressure drop in the cylinder nozzle 125 may increase, reducing performance as the gas bearing.

Thus, in this embodiment, the inlet part 123*a* of the cylinder nozzle 125 may have a relatively large diameter to reduce the pressure drop of the refrigerant introduced into the cylinder nozzle 125. In addition, the outlet part 123*b* may have a relatively small diameter to control an inflow amount of gas bearing through the cylinder nozzle 125 to a predetermined value or less.

For example, in this embodiment, a ratio of the diameter of the inlet part to the diameter of the outlet part of the cylinder nozzle 125 may be determined as a value of about 4 to about 5. The effect of the gas bearing may be expected within the above-described range.

The cylinder nozzle 125 may include first nozzle part or nozzle 125*a* that extends from the first gas inflow part 126*a* to the inner circumferential surface of the cylinder body 121, and second nozzle part or nozzle 125*b* that extends from the second gas inflow part 126*b* to the inner circumferential surface of the cylinder body 121. The refrigerant which is filtered by the cylinder filter member 126*c* while passing through the first gas inflow part 126*a* may be introduced into a space between the inner circumferential surface of the first cylinder body 121 and the outer circumferential surface of the piston body 131 through the first nozzle part 125*a*. Also, the refrigerant which is filtered by the cylinder filter member 126*c* while passing through the second gas inflow part 126*b* may be introduced into a space between the inner circumferential surface of the first cylinder body 121 and the outer circumferential surface of the piston body 131 through the second nozzle part 125*b*. The gas refrigerant flowing to the outer circumferential surface of the piston body 131 through the first and second nozzle parts 125*a* and 125*b* may provide the lifting force to the piston 130 to perform a function as the gas bearing with respect to the piston 130.

The cylinder flange 122 may include a first flange 122*a* that extends outward from the cylinder body 121 in the radial direction, and a second flange 122*b* that extends forward from the first flange 122*a*. A cylinder front part or portion 121*a* of the cylinder body 121 and the first and second flanges 122*a* and 122*b* may define a deformable space part or space 122*e* which is deformable when the cylinder 120 is press-fitted into the frame 110.

The second flange 122*b* may be press-fitted into an inner surface of the first wall 115*a* of the frame 110. That is, the inner surface of the first wall 115*a* and the outer surface of the second flange 122*b* may respectively provide press-fitting parts or potion which may be press-fitted with respect to each other.

A guide groove 115*e* for easily processing the gas hole 114 may be defined in the frame flange 112. The guide groove 115*e* may be formed by recessing at least a portion of the second wall 115*b* and defined in an edge of the filter groove 117.

While the gas hole 114 is processed, a processing mechanism may be drilled from the filter groove 117 to the frame connection part 113. The processing mechanism may interfere with the second wall 115*b* to cause a limitation in that the drilling is not easy. Thus, in this embodiment, the guide groove 1153 may be defined in the second wall 115*b*, and the processing mechanism may be disposed in the guide groove 115*e* so that the gas hole 114 may be easily processed.

Figure 9:
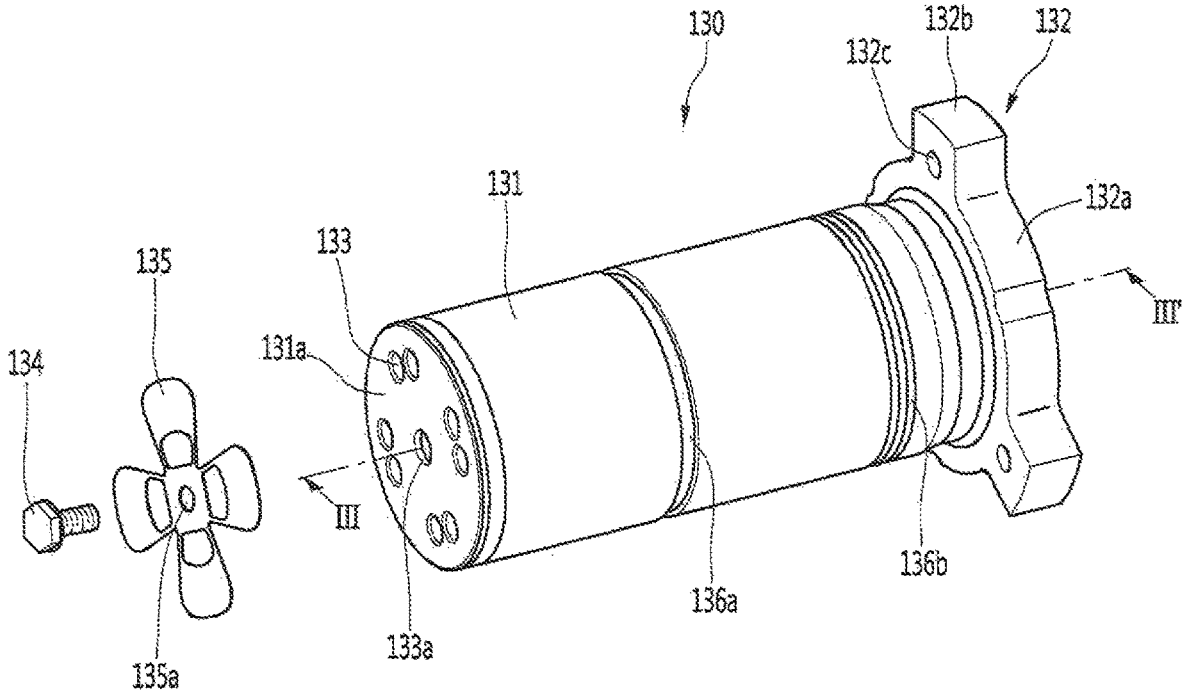
FIG. 9 is an exploded perspective view illustrating the piston and a suction valve according to an embodiment.
Figure 10:
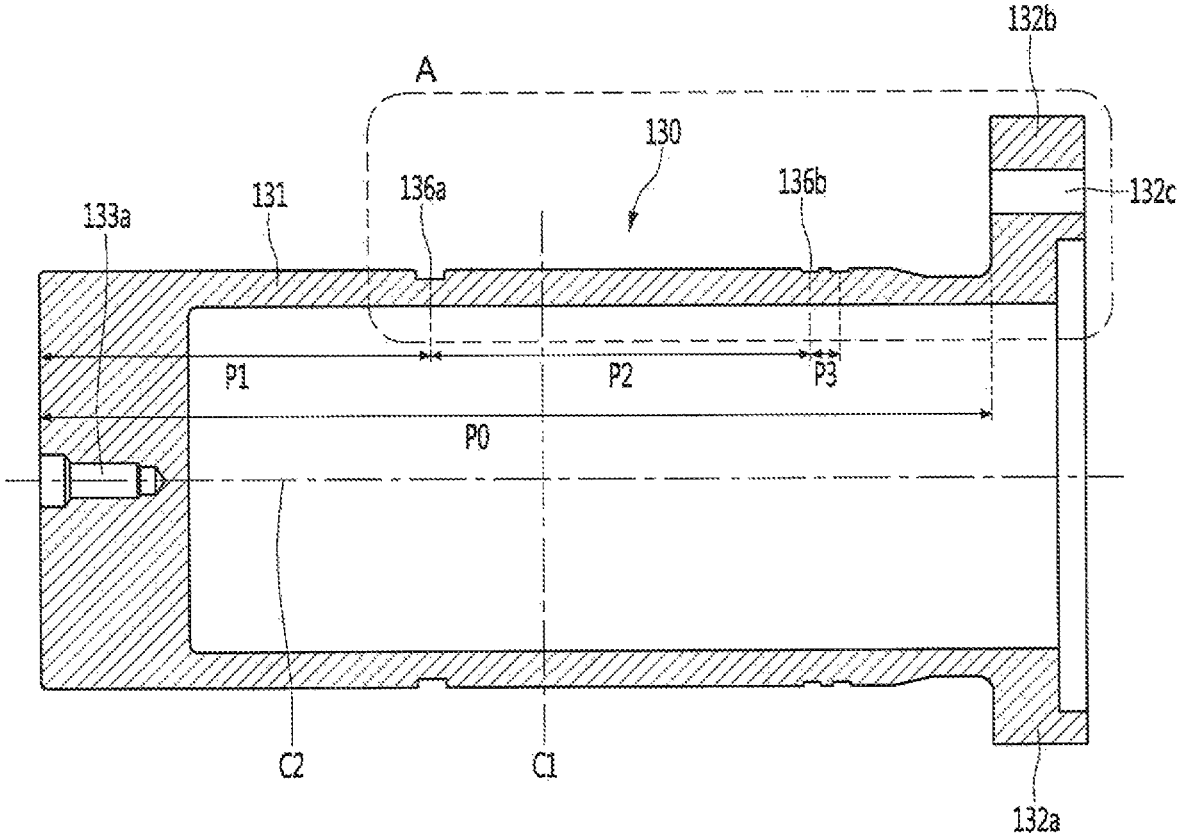
FIG. 10 is a cross-sectional view taken along line III-III' of FIG. 9.
Figure 11:
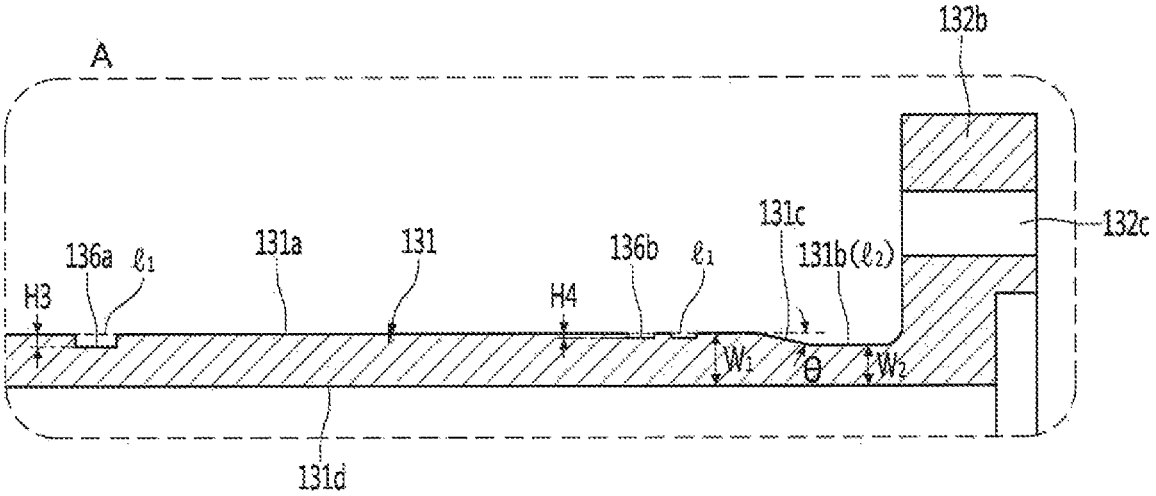
FIG. 11 is an enlarged view illustrating a portion "A" of FIG. 10.

FIG. 9 is an exploded perspective view illustrating the piston and a suction valve according to an embodiment. FIG. 10 is a cross-sectional view, taken along line III-III' of FIG. 9. FIG. 11 is an enlarged view illustrating a portion "A" of FIG. 10.

Referring to FIGS. 9 to 11, the linear compressor 10 according to an embodiment may include piston 130 that reciprocates in the axial direction, that is, the frontward and rearward direction within the cylinder 120 and suction valve 135 coupled to a front side of the piston 130.

The linear compressor 10 may further include a valve coupling member 134 that couples the suction valve 135 to a coupling hole 133*a* of the piston 130. The coupling hole 133*a* may be defined in an approximately central portion of a front end surface of the piston 130. The valve coupling member 134 may pass through a valve coupling hole 135*a* of the suction valve 135 and be coupled to the coupling hole 133*a*.

The piston 130 may include piston body 131 having an approximately cylindrical shape and extending in the frontward and rearward direction, and piston flange 132 that extends outward from the piston body 131 in the radial direction. The front portion of the piston body 131 may include a main body front end 131*a* in which the coupling hole 133*a* may be defined. Suction hole 133 which may be selectively covered by the suction valve 135 may be defined in the main body front end 131*a*.

A plurality of the suction hole 133 may be provided, and the plurality of suction holes 133 may be defined outside of the coupling hole 133*a*. For example, the plurality of suction holes 133 may be defined to surround the coupling hole 133*a*.

A rear portion of the piston body 131 may be opened to suction the refrigerant. At least a portion of the suction muffler 150, that is, the first muffler 151 may be inserted into the piston body 131 through the opened rear portion of the piston body 131.

A first piston groove 136*a* may be defined in the outer circumferential surface of the piston body 131. The first piston groove 136*a* may be defined in a front side with respect to a central line C1 in the radial direction of the piston body 131. The first piston groove 136*a* may be understood as component that guides a smooth flow of the refrigerant gas introduced through the cylinder nozzle 125 and prevents a pressure loss from occurring. The first piston groove 136*a* may be defined along a circumference of the outer circumferential surface of the piston body 131 and have, for example, a ring shape.

A second piston groove 136*b* may be defined in the outer circumferential surface of the piston body 131. The second piston groove 136*b* may be defined in a rear side with respect to the central line C1 in the radial direction of the piston body 131. The second piston groove 136*b* may be understood as a "discharge guide groove" that guides the discharge of the refrigerant gas used for lifting the piston 130 to the outside of the cylinder 120. As the refrigerant gas is discharged to the outside of the cylinder 120 through the second piston groove 136*b*, the refrigerant gas used as the gas bearing may be prevented from being introduced again into the compression space P via the front side of the piston body 131.

The second piston groove 136*b* may be spaced apart form the first piston groove 136*a* and defined along the circumference of the outer circumferential surface of the piston body 131. For example, the second piston groove 136*b* may have a ring shape. Also, a plurality of the second piston groove 136*b* may be provided.

A distance P1 from the front end of the piston body 131 to the first piston groove 136*a* may be greater than a distance P2 from a central portion of the first piston groove 136*a* to a central portion of the second piston groove 136*b*. The distance P1 may be determined so that the position of the first piston groove 136*a* is adjacent to the position of the first nozzle part 125*a*.

The second piston groove 136*b* may be spaced apart from the first piston groove 136*a* and defined along the circumference of the outer circumferential surface of the piston body 131. For example, the second piston groove 136*b* may have a ring shape. Also, a plurality of the second piston groove 136*b* may be provided in plurality.

A distance P3 between central portions of the plurality of second piston grooves 136*b* may be less than the distance P2. As the plurality of second piston grooves 136*b* may be defined adjacent to each other, discharge of the refrigerant through the plurality of second piston grooves 136*b* may be smooth.

An optimal ratio of the distances P1, P2, and P3 to a length of the piston body 131 in the axial direction may be proposed. When the length of the piston body 131 in the axial direction is P0, a value of P1 to P0 may range from about 0.40 to about 0.45. Also, a value of P2 to P0 may range from about 0.35 to about 0.40, and a value of P2 to P0 may range from about 0.02 to about 0.06. Due to the above-described ratios, a gas bearing performance and prevention effect of reintroduction of the refrigerant into the compression space P may be improved.

The second piston groove 136*b* may have a size less than a size of the first piston groove 136*a*. For example, as illustrated in FIG. 11, a depth H4 of the second piston groove 136*b* may be less than a depth that H3 of the first piston groove 136*a* with respect to the outer circumferential surface of the piston body 131. The depths H3 and H4 may be determined as values of the grooves 136*a* and 136*b*, which are measured inward in the radial direction with respect to the piston body 131, more particularly, an outer circumferential surface ℓ 1 of a first body 131*a*. Due to the above-described structure, a too large an amount of refrigerant gas used as the gas bearing may flow to the second piston groove 136*b* when compared to the first piston groove 136*a*, preventing the gas bearing from being deteriorated in performance. Also, a width of the first piston groove 136*a* in the frontward and rearward direction may be greater than a width of the second piston groove 136*b* in the frontward and rearward direction.

The piston flange 132 may include a flange body 132*a* that extends outward from the rear portion of the piston body 131 in the radial direction, and a piston coupling part or portion 132*b* that further extends outward from the flange body 132*a* in the radial direction. The piston coupling part 132*b* may include a piston coupling hole 132*c* to which a predetermined coupling member may be coupled. The coupling member may pass through the piston coupling hole 132*c* and be coupled to the magnet frame 138 and the support 137. Also, a plurality of the piston coupling part 132*b* may be provided, and the plurality of piston coupling parts 132*b* may be spaced apart from each other and disposed or provided on an outer circumferential surface of the flange body 132*a*. The second piston groove 136*b* may be disposed or provided between the first piston groove 136*a* and the piston flange 132.

The piston body 131 may include a first body 131*a* in which piston grooves 136*a* and 136*b* may be defined and extending in the axial direction, a piston inclination part or portion 131*c* that extends at an incline from the first body 131*a* in the axial direction, and a second body 131*b* that extends from the piston inclination part 131*c* to the piston flange 132 in the axial direction. The piston inclination part 131*c* may extend backward to the inside in the radial direction at a preset or predetermined angle (θ).

The second body 131*b* may have an outer diameter less than an outer diameter of the first body 131*a*. Due to the structure of the piston inclination part 131*c*, a distance from a central line C2 of the piston body 131 in the axial direction to an outer circumferential surface (ℓ 1) of the first body 131*a* may be greater than a distance from the central line C2 in the axial direction to an outer circumferential surface (ℓ 2) of the second body 131*b*.

An inner circumferential surface 131*d* of the first body 131*a* and an inner circumferential surface of the second body 131*b* may form one curved surface. Thus, the first body 131*a* may have a thickness W1 greater than a thickness of the second body 131*b*.

Due to a difference in shape and thickness of the first body 131*a* and the second body 131*b*, a flow space through which the refrigerant gas used as the gas bearing flows may be relatively large outside of the second body 131*b*. Thus, the refrigerant gas flowing through the second piston groove 136*b* may be easily discharged.

Also, as the outer circumferential surface (ℓ 2) of the second body 131*b* may be disposed at a position which is relatively far away from the inner circumferential surface of the cylinder 120, a force (lateral force) in the radial direction may be applied to the piston 130 while the piston 130 reciprocates, and movement of the piston in the radial direction may occur. Thus, a phenomenon in which the piston body 131 interferes with the rear end of the cylinder 120 may be prevented.

As the movement of the piston body 131 is guided so that a degree of freedom of the resonant springs 176*a* and 176 is secured, a stress applied to the resonant springs 176*a* and 176*b* while the compressor operates may be reduced, preventing the resonant springs 176*a* and 176*b* from being worn and damaged.

Figure 12:
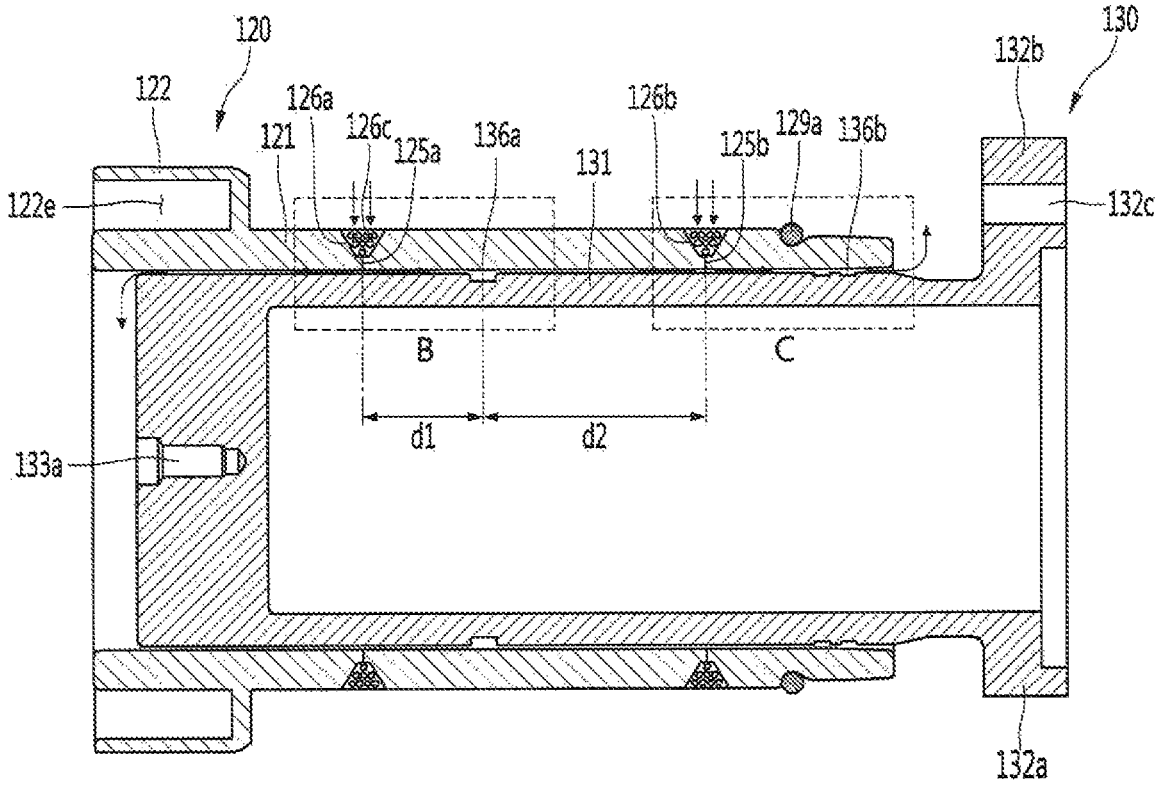
FIG. 12 is a cross-sectional view illustrating a state in which the piston is inserted into the cylinder according to an embodiment.
Figure 13:
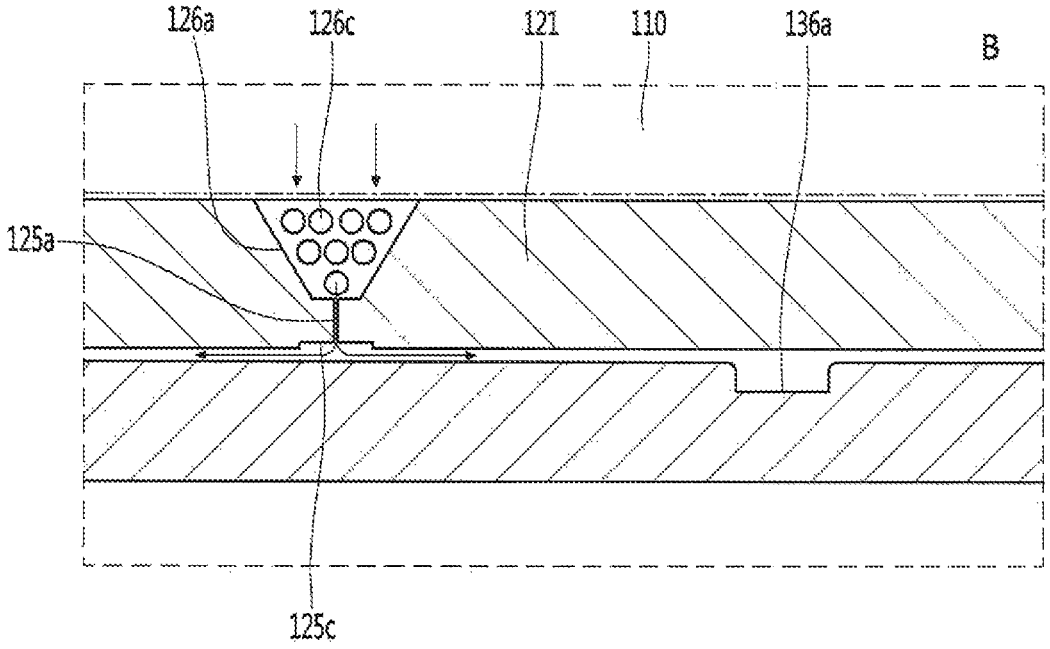
FIG. 13 is an enlarged view illustrating a portion "B" of FIG. 12.
Figure 14:
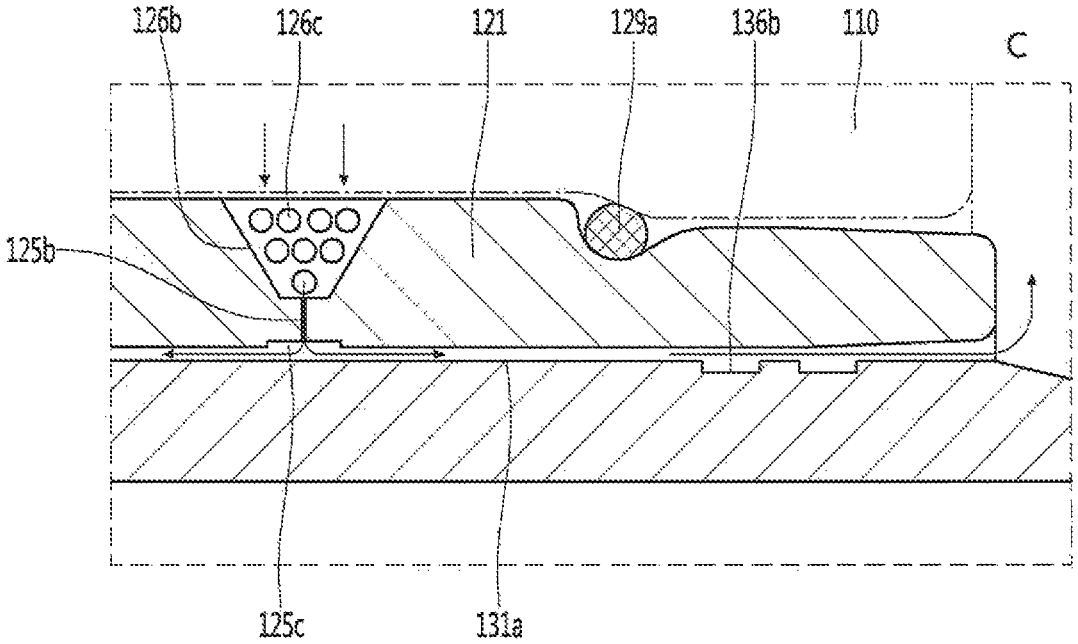
FIG. 14 is an enlarged view illustrating a portion "C" of FIG. 12.
Figure 15:
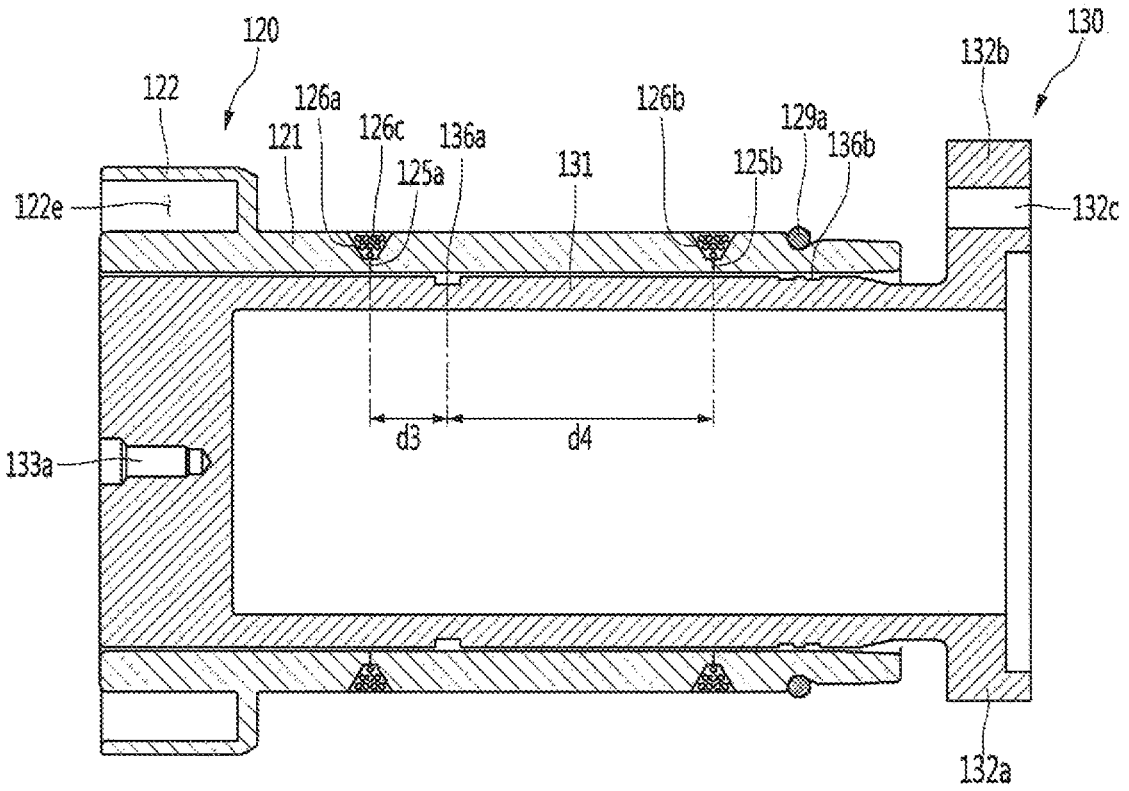
FIG. 15 is a cross-sectional view illustrating a state (top dead center (TDC)) in which the piston moves to a front side within the cylinder according to an embodiment.
Figure 16:
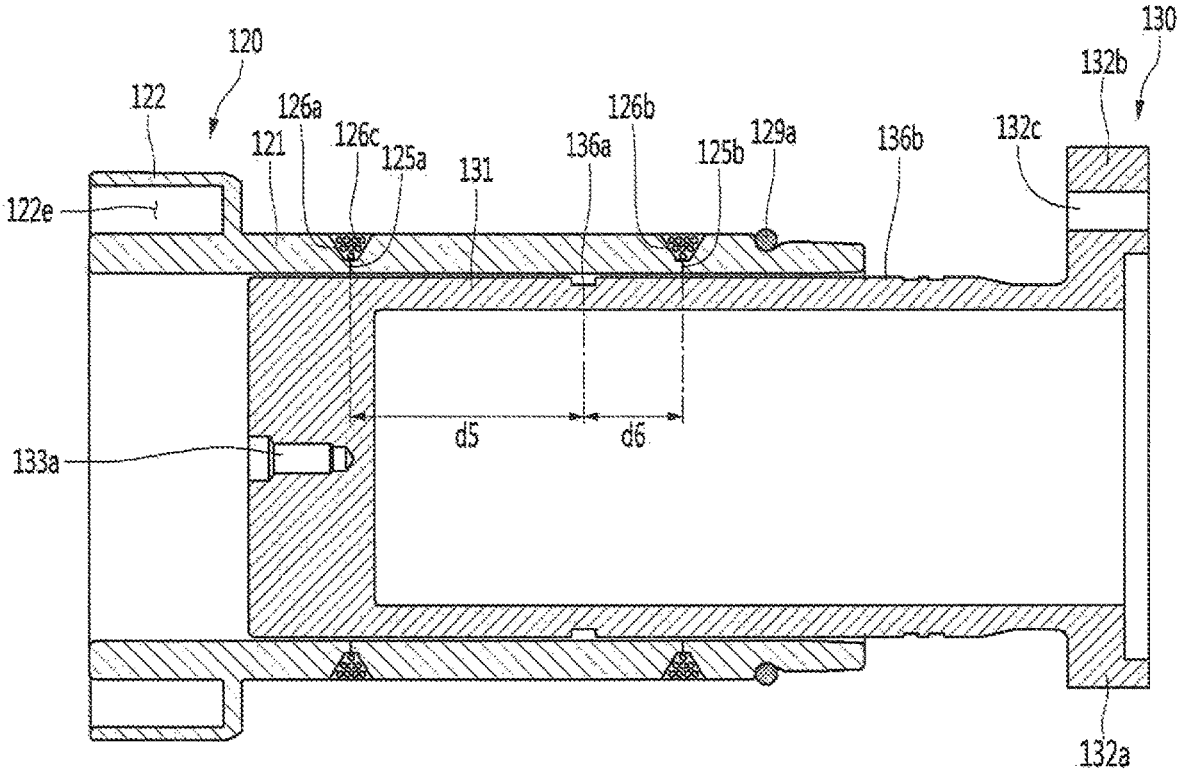
FIG. 16 is a cross-sectional view illustrating a state (bottom dead center (BDC)) in which the piston moves to a rear side within the cylinder according to an embodiment.

FIG. 12 is a cross-sectional view illustrating a state in which the piston is inserted into the cylinder according to an embodiment. FIG. 13 is an enlarged view illustrating a portion "B" of FIG. 12. FIG. 14 is an enlarged view illustrating a portion "C" of FIG. 12. FIG. 15 is a cross-sectional view illustrating a state (TDC) in which the piston moves to a front side within the cylinder according to an embodiment. FIG. 16 is a cross-sectional view illustrating a state (BDC) in which the piston moves to a rear side within the cylinder according to an embodiment.

FIG. 12 illustrates a state in which the piston 130 is initially assembled with the cylinder 120 according to an embodiment. Also, FIG. 15 illustrates a state in which the piston 130 is located at a top dead center (TDC), and FIG. 16 illustrates a state in which the piston 130 is located at a bottom dead center (BDC). The piston 130 may reciprocate between a position of FIG. 15 (hereinafter, referred to as a "first position") and a position of FIG. 16 (hereinafter, referred to as a "second position").

Referring to FIG. 13, the cylinder 120 according to an embodiment may include the gas inflow part 126 recessed inward from the outer circumferential surface of the cylinder body 121 in the radial direction, the cylinder nozzles 125*a* and 125*b* respectively extending inward from the gas inflow parts 126*a* and 126*b* in the radial direction, and an expansion part or portion 125*c* that extends from an outlet side of each of the cylinder nozzle 125*a* and 125*b* to the inner circumferential surface of the cylinder body 121. The expansion part 125*c* may be expanded from each of the cylinder nozzles 125*a* and 125*b* in the axial direction. The expansion part 125*c* may have a refrigerant flow cross-sectional area greater than a refrigerant flow cross-sectional area of each of the cylinder nozzles 125*a* and 125*b*.

The piston 130 may be lifted from the inner circumferential surface of the cylinder 120 by a pressure of the refrigerant introduced via the cylinder nozzles 125*a* and 125*b* and the expansion part 125*c*. The refrigerant passing through the cylinder 120 may have a flow cross-section area that gradually increases from the cylinder nozzles 125*a* and 125*b* toward the expansion part 125*c*. Thus, as the refrigerant passing through the cylinder nozzles 125*a* and 125*b* passes through the expansion part 125*c*, a pressure loss may not occur.

If the expansion part 125*c* is not provided, the refrigerant passing through the cylinder nozzles 125*a* and 125*b* may be directly introduced into the space between the relatively narrow cylinder 120 and the piston 130 to significantly increase the pressure drop. As a result, a sufficient lifting force may not be provided to the piston due to the reduced pressure of the refrigerant.

The expansion part 125*c* provides a space part or space in which burrs generated when the cylinder nozzles 125*a* and 125*b* are processed are received. That is, the expansion part 125*c* may be understood as a groove which is recessed from the inner circumferential surface of the cylinder body 121 to the outside of the cylinder 120. That is, the expansion part 125*c* may be understood as a "receiving part" that receives the burrs.

The piston 130 may reciprocate within the cylinder 120 in the frontward and rearward direction. During the reciprocation of the piston 130, the first piston groove 136*a* defined in the piston body 131 may be disposed or provided between the two cylinder nozzles 125*a* and 125*b* provided in the cylinder 120.

For example, in a state in which the piston 130 is initially assembled with the cylinder 120 in FIG. 12, a distance from the first piston groove 136*a* to the first nozzle part 125*a* may be d1, and a distance from the first piston groove 136*a* to the second nozzle part 125*b* may be d2. The distance d2 may be greater than the distance d1.

Also, in a state in which the piston 130 is located at the TDC in FIG. 15, a distance from the first piston groove 136*a* to the first nozzle part 125*a* may be d3, and a distance from the first piston groove 136*a* to the second nozzle part 125*b* may be d4. The distance d4 may be greater than the distance d3. Also, the distance d4 may have a value greater 5 times than the distance d3 and less than 8 times than the distance d3.

That is, the first piston groove 136*a* may be disposed or provided adjacent to the first nozzle part 125*a*. A low pressure may be generated in the first piston groove 136*a* to generate a boundary pressure with respect to the front and rear sides of the piston 130. When the discharge valve 161 is opened in the state in which the piston 130 is located at the TDC, it is advantage that the first piston groove 136*a* in which the low pressure is generated is disposed adjacent to the first nozzle part 125*a* so that a relatively large amount of high-pressure refrigerant discharged through the discharge valve 161 may be introduced through the first nozzle part 125*a*.

However, the first piston groove 136*a* and the first nozzle part 125*a* may not be disposed in parallel to each other in the radial direction. If the first piston groove 136*a* and the first nozzle part 125*a* are disposed in parallel to each other in the radial direction, a uniform dispersion of the refrigerant gas in the frontward and rearward direction with respect to the first piston groove 136*a* may be limited, deteriorating the function as the gas bearing.

Also, in a state in which the piston 130 is located at the BDC in FIG. 16, a distance from the first piston groove 136*a* to the first nozzle part 125*a* may be a distance d5, and a distance from the first piston groove 136*a* to the second nozzle part 125*b* may be a distance d6. The distance d5 may be greater than the distance d6. Also, the distance d5 may have a value greater 1.5 times than the distance d6 and less than 3 times than the distance d6.

According to the above-described structure, during the reciprocation of the piston 130, the refrigerant discharged through the discharge valve 161 may uniformly flow to the outer circumferential surface of the piston body 131 through the gas inflow part 126 and the cylinder nozzle 125 of the cylinder 120. At least a portion of the refrigerant flowing to the inner circumferential surface of the cylinder 120 through the first nozzle part 125*a* and the first gas inflow part 126*a* may flow to the front side of the piston body 131, and the remaining refrigerant may flow to the first piston groove 136*a*.

That is, as the distance between the inner circumferential surface of the cylinder 120 and the outer circumferential surface of the piston 130 is relatively large in an area in which the first piston groove 136*a* is defined, the pressure loss of the refrigerant acting as the gas bearing may not largely occur, and the refrigerant may flow to the first piston groove 136*a*.

Also, at least a portion of the refrigerant flowing to the inner circumferential surface of the cylinder 120 through the second nozzle part 125*b* and the second gas inflow part 126*b* may flow forward to the first piston groove 136*a*, and the remaining refrigerant may flow backward. As described above, due to the structure of the first piston groove 136*a*, the refrigerant may be uniformly supplied from the front side to the rear side of the piston body 131.

If the first piston groove 136*a* is not provided in the piston body 131, the high-pressure refrigerant gas may be supplied to only a surrounding region of the first nozzle part 125*a* or a surrounding region of the second nozzle part 125*b*, and a low-pressure refrigerant gas may be supplied to a region between the first and second nozzle parts 125*a* and 125*b* due to the pressure loss of the refrigerant.

Thus, a non-uniform pressure may be applied to the outer circumferential surface of the piston body 131. As a result, a stable lifting of the piston 130 from the inner circumferential surface of the cylinder 120 may be restricted. For example, the piston 130 may lean in one direction from an inner center of the cylinder 120, causing the interference between the piston 130 and the cylinder 120. In this embodiment, the above-described limitation will be prevented.

Also, the refrigerant flowing to the outer circumferential surface of the piston body 131, and thus, used as the gas bearing may be discharged to the outside of the cylinder 120. At least a portion of the refrigerant used as the gas bearing may flow to the rear side of the cylinder 120, that is, a portion into which the refrigerant is suctioned into the cylinder 120, and the remaining refrigerant may flow to the front side of the cylinder 120, that is, a portion in which the compression space P is defined.

In the refrigerant, the refrigerant flowing to the front and rear sides of the cylinder 120 and then discharged from the cylinder 120 may be introduced again to the compression space P to interrupt the flow of the refrigerant flowing to the compression space P through the suction valve 135. Thus, the compression performance of the refrigerant may be deteriorated.

Therefore, embodiments disclosed herein provide the second piston groove 136*b* in the rear portion of the piston body 131 to increase an amount of refrigerant used as the gas bearing, that is, refrigerant flowing to the rear side of the cylinder 120 in the refrigerant flowing to the outer circumferential surface of the piston body 131 through the cylinder nozzle 125. The refrigerant flowing to the rear side of the cylinder 120 may contain the refrigerant passing through the first piston groove 136*a*.

As the second piston groove 136*b* is provided in the piston body 131, the pressure loss in the rear side of the cylinder 120 may be reduced, and thus, the discharge of the refrigerant through the rear side of the cylinder 120 may be more easily performed. The refrigerant may flow to the outside through a space between the rear end of the cylinder 120 and the piston flange 132.

Thus, an amount of refrigerant flowing to the rear side of the cylinder 120 in the refrigerant used as the gas bearing may increase to relatively reduce an amount of refrigerant introduced into the compression space P. As a result, a compression efficiency of the linear compressor 10 may be improved, and power consumption may be reduced. Thus, when the linear compressor 10 is provided in a refrigerator, power consumption of the refrigerator may be reduced.

For example, when the second piston groove 136*b* is not provided in the piston body 131, a ratio of the refrigerant flowing to the front side and the rear side of the cylinder 120 of about 45:55 was confirmed through experimental results. On the other hand, when the second piston groove 136*b* is provided in the piston body 131, a ratio of the refrigerant flowing to the front side and the rear side of the cylinder 120 of about 40:60 was confirmed through the experimental results.

Figure 17:
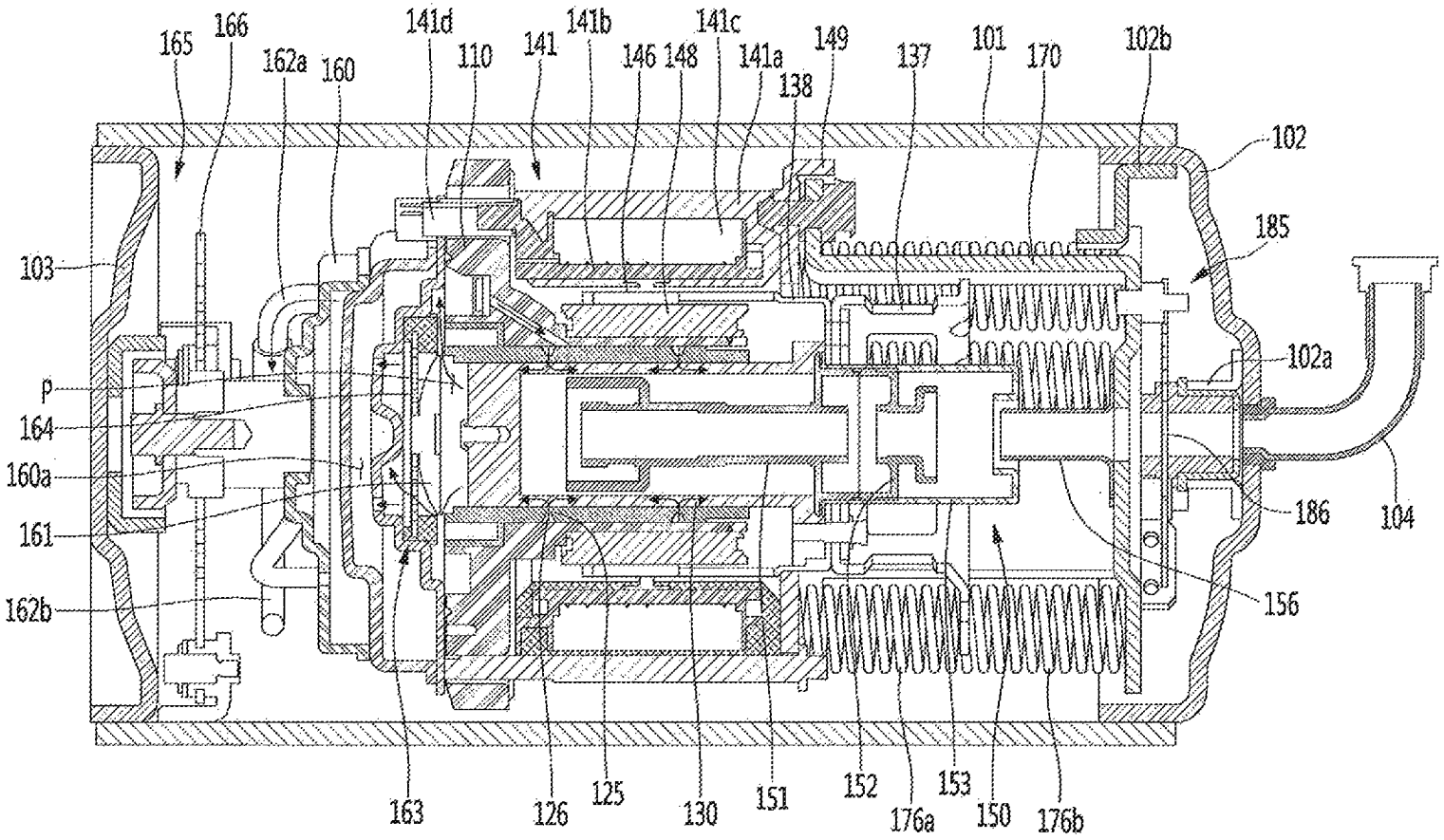
FIG. 17 is a cross-sectional view illustrating a state in which the refrigerant flows in the linear compressor according to an embodiment.

FIG. 17 is a cross-sectional view illustrating a state in which the refrigerant flows in the linear compressor according to an embodiment. Referring to FIG. 17, a refrigerant flow in the linear compressor 10 according to an embodiment will be described hereinafter. The refrigerant suctioned into the shell 101 through the suction pipe 104 may be introduced into the piston 130 via the suction muffler 150. The piston 130 may reciprocate in the axial direction by the driving of the motor assembly 140.

When the suction valve 135 coupled to the front side of the piston 130 is opened, the refrigerant may be introduced into the compression space P and then compressed. Also, when the discharge valve 161 is opened, the compressed refrigerant may be discharged into the compression space P, and a portion of the discharged refrigerant flows to the frame space part 115*d* of the frame 110. Also, the remaining refrigerant may pass through the discharge space 160*a* of the discharge cover 160 and be discharged through the discharge pipe 105 via the cover pipe 162*a* and the loop pipe 162*b*.

The refrigerant within the frame space part 115*d* may flow backward to pass through the discharge filter 200. In this process, foreign substances or oil contained in the refrigerant may be filtered.

Also, the refrigerant passing through the discharge filter 200 may be introduced into the gas hole 114 and then be supplied between the inner circumferential surface of the cylinder 120 and the outer circumferential surface of the piston 130 to perform the function as the gas bearing. The refrigerant may smoothly flow by the first piston groove 136*a* defined in the piston body 131, and thus, be uniformly supplied from the front side to the rear side of the piston body 131.

Also, the refrigerant used as the gas bearing may be discharged to the outside of the cylinder 120 through the front and rear sides of the cylinder 120. As the second piston groove 136*b* is provided in the piston body 131, a relatively large amount of refrigerant may be discharged through the rear side of the cylinder 120. Thus, an amount of refrigerant reintroduced into the compression space P may be reduced.

According to the above-described, a bearing function may be performed by using at least a portion of the discharged refrigerant without using oil to prevent the piston or the cylinder from being worn.

According to embodiments disclosed herein, the compressor including internal parts or components may be decreased in size to reduce a volume of a machine room of a refrigerator, and thus, an inner storage space of the refrigerant may increase. Also, a drive frequency of the compressor may increase to prevent internal parts or components from being deteriorated in performance due to the decreasing size thereof. In addition, the gas bearing may be applied between the cylinder and the piston to reduce a friction force occurring due to oil.

The first piston groove may be defined in the outer circumferential surface of the piston body to prevent the pressure of the refrigerant gas supplied to the outer circumferential surface of the piston body through the cylinder nozzle from being reduced. As a result, the gas bearing may be improved in performance to increase a lifting force of the piston within the cylinder.

Further, while the piston reciprocates forward and backward, the first piston groove may be defined between the two cylinder nozzles, and the refrigerant may flow to the first piston groove through the two cylinder nozzles. Therefore, the refrigerant gas may be uniformly supplied to the front and rear sides of the piston.

Furthermore, as the cylinder body may further include an expansion part or portion that extends from the cylinder nozzle to the inner circumferential surface of the cylinder body, a reduction in pressure of the refrigerant gas supplied to the piston may be reduced, and thus, a lifting force of the piston may increase.

Also, the second piston groove may be defined in a rear portion of the piston body, and thus, the refrigerant gas used as the gas bearing may be discharged to the outside of the cylinder through the second piston groove. As a result, the refrigerant gas used as the gas bearing may be prevented from being introduced again into the compression space of the cylinder to prevent a compression performance of the refrigerant from being deteriorated and improve an operation efficiency of the compressor, thereby reducing power consumption.

Also, as the second piston groove has a size or depth less than a size of the first piston groove, a phenomenon in which a relatively large amount of refrigerant gas to be used as the gas bearing flows to the second piston groove, and thus, is discharged may be prevented, preventing the gas bearing from being deteriorated in performance.

Additionally, as the piston inclination part that extends at an incline in the direction in which the outer diameter of the piston body decreases may be disposed or provided on or at one side of the second piston groove, the refrigerant gas used as the gas bearing may be easily discharged.

Embodiments disclosed herein provide a linear compressor in which a gas bearing supplied into a piston may be improved in performance. Embodiments disclosed herein also provide a linear compressor in which a pressure loss may be reduced to increase a lifting force of the piston.

Embodiments disclosed herein further provide a linear compressor in which a refrigerant gas may be uniformly supplied to front and rear sides of the piston to uniformly realize bearing performance at the front and rear sides of the piston. Embodiments disclosed herein provide a linear compressor in which a refrigerant gas supplied to an outer circumferential surface of a piston may be easily discharged to the outside of a cylinder. Embodiments disclosed herein also provide a linear compressor in which a refrigerant gas used as a gas bearing may be prevented from being introduced again into a compression space of a cylinder.

Embodiments disclosed herein provide a linear compressor that may include a piston having a first piston groove and a second piston groove. The first piston groove may be defined at a front side with respect to a central line in a radial direction of the piston, and the second piston groove may be defined at a rear side. The first piston groove may have a size greater than a size of the second piston groove.

The linear compressor may further include a cylinder into which the piston may be inserted. The cylinder may include a gas inflow part or inflow recessed from an outer circumferential surface of the cylinder and on or in which a cylinder filter member or filter may be installed or provided.

The cylinder may further include a cylinder nozzle that extends from the gas inflow part in a radial direction. The cylinder nozzle may include a first nozzle part or nozzle and a second nozzle part or nozzle. The first piston groove may be defined between the first and second nozzle parts.

The cylinder may further include an expansion part or portion that extends from the cylinder nozzle to an inner circumferential surface of the cylinder and having a cross-sectional area greater than a cross-sectional area of the cylinder nozzle. A refrigerant passing through the first and second nozzle parts may flow to the first piston groove.

A main body of the piston may include a first body having the first and second piston grooves, and a second body having an outer diameter less than an outer diameter of the first body. The main body of the piston may further include a piston inclination part or portion that extends at an incline from the first body to the second body with respect to the axial direction.

The piston may further include a piston flange that extends from the main body of the piston in the radial direction, and the second body may extend from the piston inclination part to the piston flange. A plurality of the second piston groove may be provided. The refrigerant flowing to an outer circumferential surface of the piston through the cylinder nozzle may be discharged to the outside of the cylinder via the second piston groove.

The details of one or more embodiments are set forth in the accompanying drawings and the description. Other features will be apparent from the description and drawings, and from the claims.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A linear compressor, comprising: a cylinder having a compression space for a refrigerant, the cylinder including a cylinder nozzle through which the refrigerant is introduced; and a piston provided in the cylinder and lifted by the refrigerant supplied through the cylinder nozzle, wherein the piston includes: a piston body that reciprocates within the cylinder in an axial direction, the piston body having a hollow cylindrical shape; a suction valve provided at a front portion of the piston body; a piston flange that extends from a rear portion of the piston body in a radial direction; a first piston groove defined in an outer circumferential surface of the piston body, and through which the refrigerant supplied from the cylinder nozzle flows, and a second piston groove defined in the outer circumferential surface of the piston body and spaced apart from the first piston groove, wherein the second piston groove is configured to guide the refrigerant such that a portion of the refrigerant supplied from the cylinder nozzle is discharged to an outside of the cylinder and is prevented from flowing into an inside of the piston body through the second piston groove, wherein the first piston groove and the second piston groove are configured to have an annular shape, wherein the first piston groove is spaced a first distance forward from a central line in the axial direction of the piston body, and the second piston groove is spaced a second distance rearward from the central line, wherein the second distance is greater than the first distance, and wherein the cylinder nozzle includes a first nozzle, and a second nozzle spaced apart rearward from the first nozzle in the axial direction, and the first piston groove moves between the first nozzle and the second nozzle while the piston reciprocates between a bottom dead center (BDC) and a top dead center (TDC) in the axial direction.

2. The linear compressor according to claim 1, wherein a depth of the first piston groove in the radial direction is greater than a depth of the second piston groove in the radial direction with respect to the outer circumferential surface of the piston body.

3. The linear compressor according to claim 1, wherein a width of the first piston groove in the axial direction is greater than a width of the second piston groove in the axial direction.

4. The linear compressor according to claim 1, wherein the piston body includes:

a first body having the first and second piston grooves;

a second body having an outer diameter less than an outer diameter of the first body; and a piston inclination portion that extends at an incline from the first body to the second body with respect to the axial direction.

5. The linear compressor according to claim 4, wherein the second body extends from the piston inclination portion to the piston flange in the axial direction.

6. The linear compressor according to claim 5, further including:

a support that supports the piston; and a magnet frame on which a magnet is provided, wherein the piston flange, the magnet frame, and the support are coupled to each other using a coupling member.

7. The linear compressor according to claim 4, wherein the first body has a thickness greater than a thickness of the second body.

8. The linear compressor according to claim 1, wherein the second piston groove is configured such that the refrigerant passing through the second piston groove is discharged into a space between an end of the cylinder and the piston flange.

9. The linear compressor according to claim 1, wherein the cylinder includes:

at least one gas inflow recessed from an outer circumferential surface of the cylinder and connected to the cylinder nozzle and in which a cylinder filter is provided; and an expansion portion that extends from an outlet side of the cylinder nozzle to an inner circumferential surface of the cylinder and having a cross-sectional area greater than a cross-sectional area of the cylinder nozzle.

10. The linear compressor according to claim 9, wherein refrigerant passing through the first and second nozzles flows to the first piston groove.

11. A linear compressor, comprising: a cylinder having a compression space for a refrigerant; and a piston provided in the cylinder, wherein the piston includes: a piston body that reciprocates within the cylinder in an axial direction, the piston body having a hollow cylindrical shape; a suction valve provided at a front portion of the piston body; a piston flange that extends from a rear portion of the piston body in a radial direction; a first piston groove provided in an outer circumferential surface of the piston body and formed in a ring shape, and at least one second piston groove defined along the outer circumferential surface of the piston body and formed in a ring shape, the at least one second piston groove being configured not to communicate with an inside of the piston body, the at least one second piston groove being spaced apart from the first piston groove, wherein a width of the first piston groove in the axial direction is greater than a width of the at least one second piston groove in the axial direction, wherein the first piston groove is spaced a first distance forward from a central line in the axial direction of the piston body, and the at least one second piston groove is spaced a second distance rearward from the central line, and wherein the second distance is greater than the first distance.

12. The linear compressor according to claim 11, wherein the at least one second piston groove includes a plurality of second piston grooves.

13. The linear compressor according to claim 11, further including:

at least one gas inflow recessed from an outer circumferential surface of the cylinder and in which a cylinder filter is provided; and a cylinder nozzle connected to the at least one gas inflow to supply the refrigerant into a space between an outer circumferential surface of the piston and an inner circumferential surface of the cylinder.

14. The linear compressor according to claim 1, wherein a fourth distance (d4) from the first piston groove towards the second nozzle is greater than a third distance (d3) from the first piston groove towards the first nozzle while the piston is at the top dead center (TDC).

15. The linear compressor according to claim 1, wherein a fifth distance (d5) from the first piston groove towards the first nozzle is greater than a sixth distance (d6) from the first piston groove towards the second nozzle while the piston is at the bottom dead center (BDC).

16. The linear compressor according to claim 13, wherein the cylinder nozzle includes two nozzles, and the first piston groove is positioned between the two nozzles.

17. The linear compressor according to claim 11, wherein the piston body includes:

a first body having the first and second piston grooves;

a second body that extends from the first body to the piston flange and having an outer diameter less than an outer diameter of the first body; and a piston inclination portion that extends at an incline from the first body to the second body with respect to the axial direction.

18. A linear compressor according to claim 11, wherein, when a length of the piston body in the axial direction is P0, a distance from the front end of the piston body to the first piston groove is P1, and a distance from a central portion of the first piston groove to a central portion of the at least one second piston groove is P2, a ratio of P1 to P0 ranges from about 0.40 to about 0.45, and a ratio of P2 to P0 ranges from about 0.35 to about 0.40.

19. The linear compressor according to claim 11, wherein a depth of the first piston groove in a radial direction is greater than a depth of the second piston groove with respect to the outer circumferential surface of the piston body.

* * * * *